US012180952B2

(12) United States Patent
Son et al.

(10) Patent No.: US 12,180,952 B2
(45) Date of Patent: Dec. 31, 2024

(54) HERMETIC COMPRESSOR

(71) Applicant: LG ELECTRONICS INC., Seoul (KR)

(72) Inventors: Youngboo Son, Seoul (KR); Hangjun Cho, Seoul (KR); Seokjong Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 507 days.

(21) Appl. No.: 17/323,191

(22) Filed: May 18, 2021

(65) Prior Publication Data

US 2022/0049690 A1 Feb. 17, 2022

(30) Foreign Application Priority Data

Aug. 12, 2020 (KR) ..... 10-2020-0101318

(51) Int. Cl.
*F04B 39/12* (2006.01)
*F04B 53/00* (2006.01)

(52) U.S. Cl.
CPC ..... *F04B 39/127* (2013.01); *F04B 39/121* (2013.01); *F04B 53/003* (2013.01)

(58) Field of Classification Search
CPC .... F04B 39/0044; F04B 39/023; F04B 39/12; F04B 39/121; F04B 39/127; F04B 53/001; F04B 53/002; F04B 53/003
See application file for complete search history.

(56) References Cited

U.S. PATENT DOCUMENTS 2,349,845 A * 5/1944 Cody ..... F04B 39/127 417/419
3,030,056 A * 4/1962 Rogers ..... F16F 3/04 267/168
4,406,593 A * 9/1983 Kessler ..... F04B 39/14 248/618

(Continued)

FOREIGN PATENT DOCUMENTS

KR 10-2001-0105685 11/2001
KR 10-2002-0056300 7/2002

(Continued)

OTHER PUBLICATIONS

KR20060091644A_MT; English translation of KR-20060091644 (Year: 2006).*

(Continued)

*Primary Examiner* — Dominick L Plakkoottam
*Assistant Examiner* — Charles W Nichols
(74) *Attorney, Agent, or Firm* — KED & ASSOCIATES

(57) ABSTRACT

A hermetic compressor may include a plurality of springs provided between a compressor body and a shell to elastically support the compressor body and to space the compressor body apart from an inner surface of a shell. A plurality of spring caps fixed to the inner surface of the shell and the compressor body may support ends of each of the plurality of springs. Each of the plurality of springs may be inclined with respect to an axial direction. Transverse stiffness of the support springs may be increased to thereby reduce vibration noise of the compressor body and prevent the compressor body from being in contact with the shell.

14 Claims, 17 Drawing Sheets

(56) References Cited

U.S. PATENT DOCUMENTS

| | | | | |
|---|---|---|---|---|
| 4,712,778 | A * | 12/1987 | Newman | F16F 1/125 267/179 |
| 6,004,113 | A * | 12/1999 | Vay | F04B 39/127 417/363 |
| 11,339,844 | B2 * | 5/2022 | Mimura | F16F 15/12333 |
| 2006/0251529 | A1 * | 11/2006 | Kim | F04B 35/045 417/417 |
| 2016/0195080 | A1 | 7/2016 | Miguel et al. | |
| 2017/0152907 | A1 * | 6/2017 | Kato | F16F 1/125 |
| 2018/0010662 | A1 * | 1/2018 | de Lima Zocca | F16F 1/06 |

FOREIGN PATENT DOCUMENTS

| | | | | |
|---|---|---|---|---|
| KR | 10-2006-0091644 | | 8/2006 | |
| KR | 20060091644 | A * | 8/2006 | |
| KR | 10-2013-0120023 | | 11/2013 | |
| KR | 10-2016-0132665 | | 11/2016 | |
| WO | WO-2005028870 | A1 * | 3/2005 | F04B 39/0044 |

OTHER PUBLICATIONS

Korean Office Action issued in Application No. 10-2020-0101318 dated Aug. 26, 2021.

* cited by examiner

HERMETIC COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2020-0101318, filed in Korea on Aug. 12, 2020, the contents of which are incorporated by reference herein in their entirety.

BACKGROUND

1. Field

The present disclosure relates to a hermetic compressor.

2. Background

A hermetic compressor may be a compressor in which both a motor and a compression unit or compressor that define a compressor body are installed at an inner space of a shell. A hermetic compressor may be classified as a fixed support method type or an elastic support method type according to a method of supporting the compressor body with respect to the shell.

In the fixed support method type, the compressor body may be partially or entirely brought into close contact with the inner surface of the shell. In the elastic support method type, the compressor body may be elastically supported with respect to an inner circumferential surface of a shell.

A reciprocating compressor may be an elastic support method type. The reciprocating compressor may use a compression coil spring to elastically support a lower end of the compressor body at a bottom surface of the shell. Such a reciprocating compressor can be classified into a connection type reciprocating compressor or a vibration type reciprocating compressor according to a method of operating a piston.

Korean Laid-Open Patent Application No. 10-2013-0120023 discloses a connection type reciprocating compressor having a piston connected to a rotating motor through a rotating shaft and a connecting rod that performs a reciprocating motion in a cylinder. Korean Laid-Open Patent Application No. 10-2016-0132665 discloses a vibration type reciprocating compressor having a piston connected to a rotator of a reciprocating motor that performs a reciprocating motion in a cylinder.

In both the connection type reciprocating compressor and the vibration type reciprocating compressor, transverse vibration may be generated as the piston reciprocates with respect to the cylinder. A support spring configured as a compression coil spring may be used to support a compressor body on an inner surface of a shell.

However, in such a reciprocating compressor, as the compressor body installed in the shell may be supported in a longitudinal direction by a support spring configured as a compression coil spring, the compressor body may not be securely supported in a transverse direction compared to the longitudinal direction. For example, during stop, start, inclined operation, or transport of the compressor, the compressor body inside the shell may be severely shaken in the transverse direction. This disruption may cause increased vibration noises or collision between the compressor body and the shell, reducing reliability of the compressor body.

U.S. Patent No. 2016/0195080 A1 discloses a reciprocating compressor having a compressor body that is mechanically supported on a shell by installing a damping member between an inner circumferential surface and the compressor body, in addition to a support spring to suppress collision between the compressor body and the shell. However, the number of parts and labor may be increased, which may increase manufacturing costs of the compressor and the size of the compressor. In addition, even when a damping member or stopper member is installed, such damping member may not be completely fixed without any gap or clearance to cause a collision between the compressor body and the damping member. This collision force may be transmitted to the shell through the damping member, which may cause vibration noise of the compressor. The damping member may not effective at suppressing a collision between the compressor body and the shell.

Further, when reducing a shell in size in order to achieve a small-sized reprocessing compressor, a gap or interval between the shell and a compressor body may be further reduced, which may cause frequent collisions therebetween. For this reason, a demand for the damping member (or stopper member) may be increased, however, the damping member (or stopper member) may not effectively prevent a collision between the compressor body and the shell.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a hermetic compressor according to one or more implementations of the present disclosure will be described in detail with reference to the accompanying drawings. As described above, in the hermetic compressor, a motor and a compression unit or compressor constructing a compressor body may be installed in a shell. In such a hermetic compressor, the compressor body may be fixed to the shell or be elastically supported on the shell by a support spring. The implementations disclosed herein will take the latter as an example, that is, an elastically supported hermetic compressor in which a compressor body is elastically supported on a shell by a support spring. Such an elastically supported hermetic compressor can be classified into various types according to a compression method. In the implementations disclosed herein, a connection type reciprocating compressor will be used as a representative example. However, embodiments disclosed herein are not limited thereto, and the implementations disclosed herein may also be applied to any hermetic compressor in which a compressor body is elastically supported on a shell.

Figure 1:
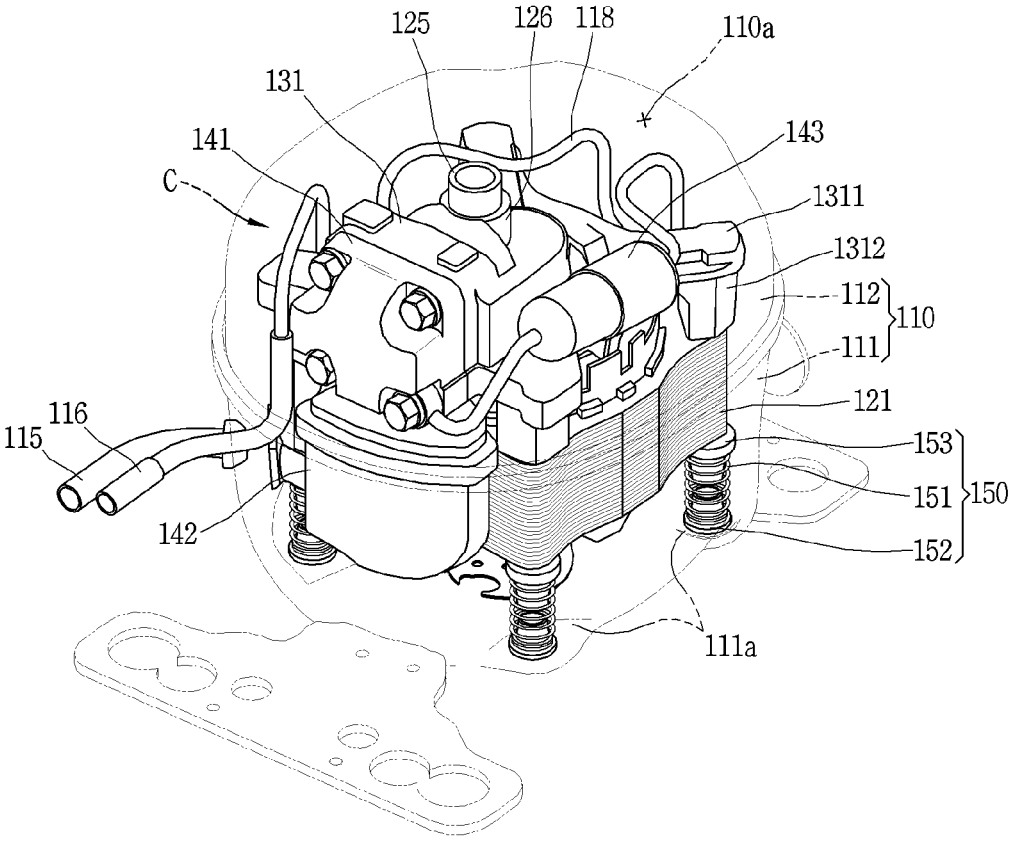
FIG. 1 is a see-through perspective view illustrating a shell of an example reciprocating compressor.
Figure 2:
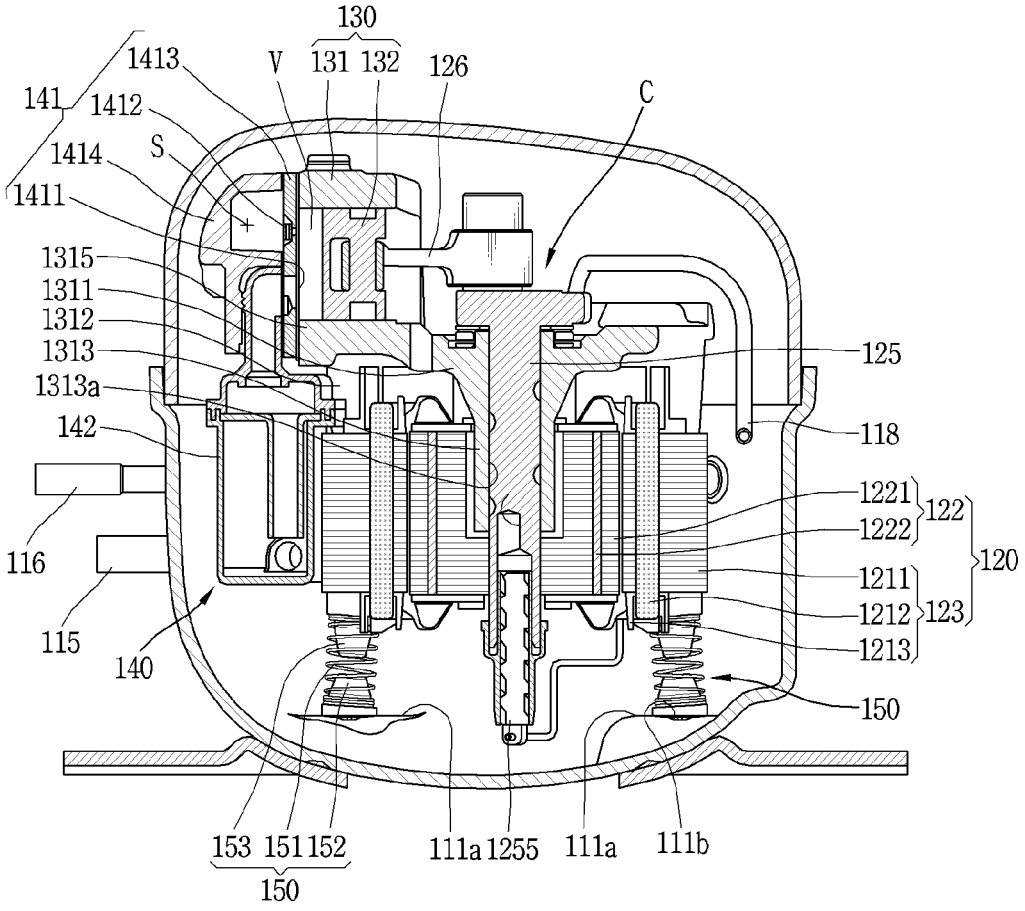
FIG. 2 is a cross-sectional view illustrating an inside of the reciprocating compressor of FIG. 1.

As illustrated in FIGS. 1 and 2, a reciprocating compressor may include a shell 110 that defines an outer appearance, a motor unit or motor 120 that is provided at an inner space 110*a* of the shell 110 to provide a driving force, a compression unit or compressor 130 that compresses a refrigerant by receiving the driving force from the motor 120, a suction and discharge assembly 140 that guides a refrigerant to a compression chamber V and discharges a compressed refrigerant, and a support 150 that supports a compressor body C including the motor 120 and the compressor 130 with respect to the shell 110.

The inner space 110*a* of the shell 110 is sealed to receive the motor 120 and the compressor 130. The shell 110 is made of an aluminum alloy (hereinafter, abbreviated as "aluminum") that is lightweight and has a high thermal conductivity, and the shell 110 includes a base shell 111 and a cover shell 112.

The base shell 111 may have a substantially hemisphere shape. A suction pipe 115, a discharge pipe 116, and a process pipe may be coupled to and penetrate the base shell 111. The suction pipe 115, the discharge pipe 116, and the process pipe may be coupled to the base shell 111 by insert die casting.

A cap mounting or seating surface 111*a* on which a first spring cap 152 described hereinafter is placed may be formed on a bottom surface of the base shell 111. A cap accommodation groove or first cap groove 111*b* that supports the first spring cap 152 may be provided on the cap mounting surface 111*a*.

The cap mounting surface 111*a* may be formed in an annular shape throughout an entire bottom surface of the base shell 111 or be provided to correspond to a number of first spring caps or support springs 152. In some implementations, the first spring cap 152 may be radially provided at four places or points, and the cap mounting surface 111*a* may also be radially formed at four points of the bottom surface of the base shell 111.

Figure 3:
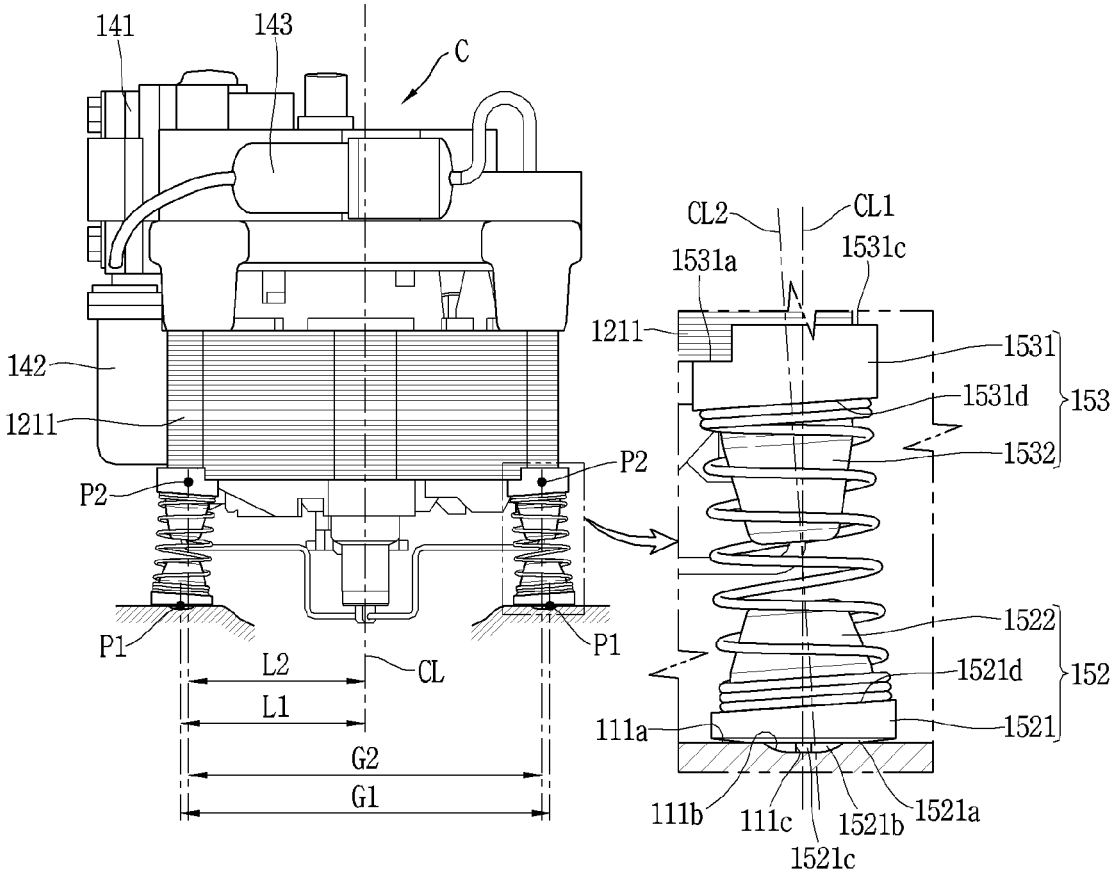
FIG. 3 is a side view of a compressor body in FIG. 1 from a direction that crosses a movement direction of a piston.

The cap accommodation groove 111*b* and a cap fixing groove or second cap groove 111*c* may be formed on the cap mounting surface 111*a*. The cap accommodation groove 111*b* may have a shape that corresponds to a shape of a lower surface of the first spring cap 152. Referring to FIG. 3, A first cap fixing surface 1521*a* that defines a lower surface of the first spring cap 152 may be provided with a first cap support protrusion 1521*b* which convexly curves toward the center. The cap accommodation groove 111*b* may have a concave shape curved inward toward the center so as to correspond to the first cap support protrusion 1521*b*.

The cap fixing groove 111*c* may have a shape that corresponds to a cap fixing protrusion 1521*c* provided on the lower surface of the first spring cap 152. The cap fixing groove 111*c* may be recessed within the cap accommodation groove 111*b* to have an angular cross-sectional shape, such as a cuboid, to increase a contact area with the cap fixing protrusion 1521*c* and to effectively suppress the first spring cap 152 from being pushed in a radial direction.

Although not illustrated in the drawings, positions of the cap fixing protrusion 1521*c* and the cap fixing groove 111*c* may be opposite to the example described above. For instance, a cap fixing protrusion 1521*c* may be formed on the cap mounting surface 111*a* of the base shell 111, and the cap fixing groove 111*c* that faces the cap fixing protrusion 1521*c* may be formed on the cap fixing surface 1521*a* of the first spring cap 152.

The cover shell 112 may have a substantially hemispherical shape like the base shell 111. The cover shell 112 may be coupled to an upper portion of the base shell 111 to define the inner space 110*a* of the shell 110. The cover shell 112 and the base shell 111 may be coupled by welding. However, the base shell 111 and the cover shell 112 may alternatively be coupled by a bolt when they are made of an aluminum material that is not suitable for welding.

A description will now be given of the motor 120. As illustrated in FIGS. 1 and 2, the motor 120 may include a stator 121 and a rotor 122.

The stator 121 may be elastically supported with respect to the bottom surface of the base shell 11 in the inner space 110*a* of the shell 110, and the rotor 122 may be rotatably installed inside the stator 121. In some implementations, the stator 121 may include a stator core 1211 and a stator coil 1212.

The stator core 1211 may be made of a metal material, such as an electrical steel sheet, and perform electromagnetic interaction with the stator coil 1212 and the rotor 122 through an electromagnetic force when a voltage is applied to the motor 120 from the outside. In addition, the stator core 1211 may have a substantially rectangular cylinder shape. For example, an inner circumferential surface of the stator core 1211 may be formed in a circular shape, and an outer circumferential surface thereof may be formed in a rectangular shape. Bolt holes or openings, or alternatively grooves, (see FIG. 9) 1211*a* may be formed through four corners of the stator core 1211, respectively, so as to allow a stator fastening bolt 1215 to pass therethrough to be fastened to a cylinder block 131 described hereinafter. Accordingly, the stator core 1211 may be fixed to the lower surface of the cylinder block 131 by the stator fastening bolts 1215.

A lower end of the stator core 1211 may be supported by a support spring 151 with respect to a bottom surface of the shell 110 when the stator core 1211 is axially and radially spaced apart from an inner surface of the shell 110, which may prevent vibration generated during operation from being directly transferred to the shell 110. The stator coil 1212 may be wound inside the stator core 1211. As described above, when a voltage is applied, the stator coil 1212 may generate an electromagnetic force to perform electromagnetic interaction with the stator core 1211 and the rotor 122 and to allow the motor 120 to generate a driving force for the compressor 130 to perform a reciprocating motion.

An insulator 1213 may be provided between the stator core 1211 and the stator coil 1212 to prevent direct contact between the stator core 1211 and the stator coil 1212 and thereby facilitate the electromagnetic interaction. In some implementations, the rotor 122 may include a rotor core 1221 and magnets 1222.

The rotor core 1221 may be made of a metal material such as an electrical steel plate, the same as that of the stator core 1211, and may have a substantially cylindrical shape. A crankshaft 125 to be described hereinafter may be press-fitted and coupled to a central portion of the rotor core 1221.

The magnets 1222 may be configured as permanent magnets and be inserted into the rotor core 1221 at equal intervals along a circumferential direction of the rotor core 1221. When a voltage is applied, the rotor 122 may be rotated by electromagnetic interaction with the stator core 1211 and the stator coil 1212. The crankshaft 125 may rotate together with the rotor 122, allowing a rotational force of the motor 120 to be transferred to the compressor 130 through a connecting rod 126.

Hereinafter, the compressor 130 will be described. As illustrated in FIGS. 1 and 2, the compressor 130 may include the cylinder block 131 and a piston 132. The cylinder block 131 may be elastically supported on the shell 110, and the piston 132 may be coupled to the crankshaft 125 by the connecting rod 126 to perform a relative motion with respect to the cylinder block 131.

In some implementations, the cylinder block 131 may be provided at an upper portion of the motor 120. The cylinder block 131 may include a frame 1311, a fixing protrusion 1312 coupled to the stator 121 of the motor 120, a shaft receiving or accommodating portion or support 1313 that supports the crankshaft 125, and a cylinder 1315 that defines a compression chamber V.

The frame 1311 may have a flat plate shape extending in a transverse direction, or a radial plate shape by processing a portion of an edge excluding corners to reduce weight or thickness. The fixing protrusion 1312 may be provided at an edge of the frame 1311. For example, the fixing protrusion 1312 may protrude from the edge of the frame 1311 toward the motor 120 in a downward direction.

In addition, a fastening hole may be formed in the fixing protrusion 1312 to communicate with the bolt hole 1211*a* provided in the stator 121. The cylinder block 131 and the stator 121 may be coupled by the stator fastening bolt 1215 to be elastically supported on the base shell 111 together with the stator 121 of the motor 120.

The shaft receiving portion 1313 may extend from a central portion of the frame 1311 in both directions of an axial direction. A shaft receiving hole 1313*a* may be axially formed through the shaft receiving portion 1313 so as to allow the crankshaft 125 to penetrate therethrough, and a bush bearing may be insertedly coupled to an inner circumferential surface of the shaft receiving hole 1313*a*.

The cylinder 1315 may be radially eccentric from one edge of the frame 1311. The cylinder 1315 may radially penetrate the cylinder block 131 so that the piston 132 connected to the connecting rod 126 may be inserted into an inner open end thereof, and a valve assembly 141 constructing the suction and discharge assembly 140 may be inserted into an outer open end thereof.

In some implementations, the piston 132 may have a first or opened side (e.g., a rear side) that is opened and faces the connecting rod 126 and a second or closed side opposite to the first side (e.g., a front side) that is closed. The connecting rod 126 may be inserted into the rear side of the piston 132 to be rotatably coupled, and the front side of the piston 132 may define the compression chamber V inside the cylinder 1315 together with the valve assembly 141.

The piston 132 may be made of the same material as the cylinder block 131, (e.g., an aluminum alloy) to prevent a magnetic flux from being transmitted to the piston 132 from the rotor 122. As the piston 132 may be made of the same material as the cylinder block 131, the piston 132 and the cylinder block (more precisely, the cylinder) 131 may have the same coefficient of thermal expansion. Accordingly, even when the inner space 110*a* of the shell 110 has a high temperature (approximately 100° C.) during operation of the hermetic compressor, interference between the cylinder block 131 and the piston 132, caused by thermal expansion, may be suppressed or reduced.

Hereinafter, the suction and discharge assembly 140 will be described. As illustrated in FIGS. 1 and 2, the suction and discharge assembly 140 may include the valve assembly 141, a suction muffler 142, and a discharge muffler 143. The valve assembly 141 and the suction muffler 142 may be sequentially coupled from the outer open end of the cylinder 1315.

In some implementations, the valve assembly 141 may include a suction valve 1411 and a discharge valve 1412 so as to be coupled to an end of the cylinder block 131. The suction valve 1411 and the discharge valve 1412 may be provided together on a same valve plate, or alternatively may be provided in a separate manner.

The suction valve 1411 may be opened and closed in a direction toward the piston 132, whereas the discharge valve 1412 may be opened and closed in a direction opposite to the suction valve 1411. The discharge valve 1412 may be provided with a retainer that limits a degree of opening of the discharge valve 1412, unlike the suction valve 1411.

The valve assembly 141 may further include a valve plate 1413 that supports the suction valve 1411 and a cylinder cover 1414 that is coupled to the valve plate 1413 and supports the suction muffler 142. The valve plate 1413 and the cylinder cover 1414 may be coupled to the cylinder block 131 by a bolt, and a discharge space S may be formed in the cylinder cover 1414 so as to be connected to the discharge muffler 143 through a loop pipe 118.

In some implementations, the suction muffler 142 may transfer a refrigerant suctioned through the suction pipe 116 to the compression chamber V of the cylinder 1315. The suction muffler 142 may be fixedly coupled to an end surface of the cylinder block 131 by the valve assembly 141 or a clamp.

The suction muffler 142 may be provided therein with a suction space portion. An inlet or entrance of the suction space portion may communicate with the suction pipe 115 in a direct or indirect manner, and an outlet or exit of the suction space portion may directly communicate with a suction side of the valve assembly 141.

In some implementations, the discharge muffler 143 may be installed separately from the cylinder block 131. The discharge muffler 143 may be provided therein with a discharge space portion. An inlet of the discharge space portion may be connected to a discharge side of the valve assembly 141 by the loop pipe 118, and an outlet of the discharge space portion may be directly connected to the discharge pipe 116 by the loop pipe 118.

Figure 4:
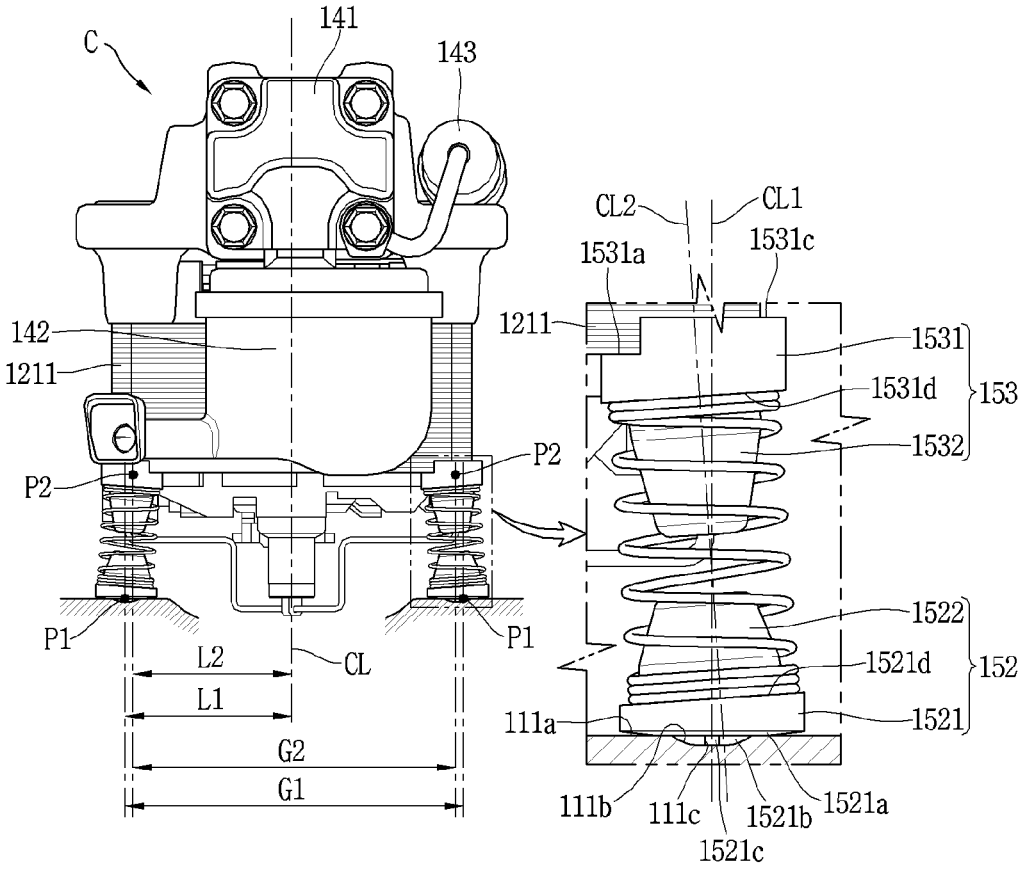
FIG. 4 is a front view of the compressor body in FIG. 1 from a movement direction of a piston.

Hereinafter, the support 150 will be described. As illustrated in FIGS. 3 and 4, a plurality of supports 150 may be provided between a lower surface of the motor 120 and a bottom surface of the base shell 111 that faces the lower surface of the motor 120. The supports 150 may be configured support four corners of the motor 120 with respect to the shell 110. In some implementations, each of the supports 150 may include the support spring 151, the first spring cap 152, and a second spring cap 153. Each support 150 may define a unitary support assembly made up of the support spring 151, the first spring cap 152, and the second spring cap 153, and the unitary support assemblies defined respectively by the supports 150 may be installed along a periphery of the compressor body C to be spaced apart by predetermined intervals or gaps.

For example, the supports 150 defining the unitary support assemblies may be respectively provided at four corners of the compressor body C to be provided symmetrical with respect to a center of the compressor body C. In addition, the unitary support assemblies defined by the supports 150 may be provided such that a gap or interval between adjacent supports 150 or support assemblies (e.g., support springs) may be increased toward the bottom surface of the shell. Hereinafter, a pair of unitary support assemblies or supports 150 will be described as a representative example.

In some implementations, the support spring 151 may be configured as a compression coil spring. A lower end of the support spring 151 may be insertedly fixed to the first spring cap 152, and an upper end of the support spring 151 may be insertedly fixed to the second spring cap 153. Accordingly, the stator core 1211 that may partially define the compressor body C may be elastically supported on the shell 110 by the support spring 151.

In some implementations, the first spring cap 152 may be fixed to the bottom surface of the base shell 111, and the second spring cap 153 may be fixed to a lower end of a stator fastening bolt that penetrates through the stator core 1211, or the lower surface of the motor 120. The first spring cap 152 and the second spring cap 153 may be located along different axial lines. When a point where the first spring cap 152 is fixed to the cap mounting surface 111*a* of the base shell 111 is referred to as 'a first fixing point P1' and a point where the second spring cap 153 is fixed to a lower surface of the compressor body C is referred to as a 'second fixing point P2,' the first fixing point P1 may be radially eccentric with respect to the second fixing point P2.

The support springs 151 may be inclined with respect to the axial direction so that a gap between adjacent support springs 151 may be increased or widened toward the cap mounting surface 111*a*, which is the bottom surface of the base shell 111. For example, when a gap between the first fixing points P1 is referred to as a 'first gap G1', and a gap between the second fixing points P2 is referred to as a 'second gap G2', the first gap G1 may be greater (larger) than the second gap G2.

When a radial distance from an axial center line CL that passes through a center Oc of the compressor body C to one of the first fixing points P1 is referred to as a 'first distance L1' and a radial distance from the axial center line CL to one of the second fixing points P2 is referred to as a 'second distance L2,' the first distance L1 may be greater than the second distance L2.

As described above, when the first spring cap 152 and the second spring cap 153 are provided on different axial lines, the second spring cap 153 may be located more outward than the first spring cap 152 to support the compressor body C more securely. This will be discussed again later.

The first spring cap 152 and the second spring cap 153 may be made of a rubber material, or may alternatively be formed by wrapping an outer circumferential surface of a metal material with a rubber or plastic material for enhancing installation stiffness and buffering (protection). For example, the first spring cap 152 may be made of a metal material to be firmly supported by being inserted into the cap fixing groove 111*c* of the base shell 111 that is made of a metal. The second spring cap 153 may be made of a rubber or plastic material as the second spring cap 153 is inserted into and fixed to a bolt head portion 1215*a* of the stator fastening bolt 1215 that axially protrudes from a lower surface of the stator core 1211.

In the drawings, an unexplained reference numeral 1255 denotes an oil feeder.

The reciprocating compressor in the example described above may operate as follows. Referring to FIGS. 1-2, when power is applied to the motor 120, the rotor 122 may rotate. When the rotor 122 rotates, the crankshaft 125 coupled to the rotor 122 may rotate together to thereby transfer a rotational force to the piston 132 through the connecting rod 126. The connecting rod 126 allows the piston 132 to perform a reciprocating motion in a front and rear direction with respect to the cylinder 1315.

For example, when the piston 132 moves backward from the cylinder 1315, volume of the compression chamber V may increase. When the volume of the compression chamber V is increased, a refrigerant filled in the suction muffler 142 may pass through the suction valve 1412 of the valve assembly 141, and may then be sucked into the compression chamber V of the cylinder 1315.

In contrast, when the piston 132 moves forward from the cylinder 1315, volume of the compression chamber V may decrease. When the volume of the compression chamber V is decreased, a refrigerant filled in the compression chamber V may be compressed, pass through the discharge valve 1413 of the valve assembly 141, and then be discharged to the discharge muffler 143. This refrigerant may be discharged to a refrigeration cycle through the discharge pipe 116. Such series of processes may be repeated.

Here, due to characteristics of the reciprocating compressor, an eccentric portion of the crankshaft 125, the connecting rod 126, and the piston 132 may be provided to be eccentric in a compression direction (transverse direction or radial direction), and thus the reciprocating compressor may have an eccentric mass in the compression direction of the piston. The compressor body C may vibrate when the crankshaft 125 rotates due to the eccentric mass of these members.

This vibration may be transmitted to the shell 110 through the support 150 to cause vibration of the hermetic compressor. However, the vibration transferred from the compressor body C to the shell 110 may be attenuated by the support spring 151 constructing the support 150.

Performance of the support 150 may be related to spring stiffness or rigidity of the support spring 151. For example, if stiffness in a longitudinal direction of the support spring 151 is high, the support spring 151 may not effectively absorb vibration transmitted from the compressor body C to the shell 110. As stiffness of the support spring 151 decreases, the vibration transferred from the compressor body C to the shell 110 may be effectively absorbed by the support spring 151. Hereinafter, a longitudinal direction will be defined as an axial direction, and a transverse direction will be defined as a radial direction, however, the longitudinal direction and the transverse direction will be used in combination with the axial direction and the radial direction, respectively.

However, if stiffness of the support spring 151 is too low, an amount of transverse displacement of the compressor body C (hereinafter, "transverse amplitude") increases, which may result in increasing vibration noise of the compressor body C or a possibility of collision between the compressor body C and the shell 110. Vibration noise of the compressor body C, or collision between the compressor body C and the shell 110, may occur more significantly during stop/restart, inclined operation, or transport of the hermetic compressor. In order to prevent this, in some implementations, the spring cap 153 and a stopper bar may be provided to mechanically constrain the compressor body C, thereby suppressing an excessive increase in the transverse amplitude of the compressor body C.

As illustrated in FIGS. 3 and 5 to 7, the first spring cap 152 may include a first spring support portion or base 1521 and a first spring insertion portion or insert 1522. The first spring cap 152 may be fixed to the cap mounting surface 111*a* of the base shell 111 by welding, etc. Accordingly, the first spring cap 152 may be made of a metal material.

The first spring support portion 1521 may have a disk shape. A lower surface of the first spring support portion 1521 may be mounted on the bottom surface of the base shell 111 at the cap mounting surface 111*a* by being brought into close contact therewith.

The first cap support protrusion 1521*b* and the cap fixing protrusion 1521*c* may be provided at a central portion of the first cap fixing surface 1521*a* defined by the lower surface of the first spring support portion 1521. For example, the cap accommodation groove 111*b* and the cap fixing groove 111*c* may be formed on the cap mounting surface 111*a* of the base shell 111, the first cap support protrusion 1521*b* may protrude toward the cap accommodation groove 111*b*, and the cap fixing protrusion 1521*c* may protrude toward the cap fixing groove 111*c*.

The first cap support protrusion 1521*b* may have a hemisphere shape which is curved and protruded toward the central portion of the first cap fixing surface 1521*a*.

When assembling the first spring cap 152, the first cap support protrusion 1521*b* may be inserted into the cap accommodation groove 111*b*, allowing an assembly position to be quickly aligned. At approximately the same time, the first cap support protrusion 1521*b* inserted into the cap accommodation groove 111*b* may be fixed to the base shell 111 by spot welding to securely maintain an assembled state of the first spring cap 152.

The cap fixing protrusion 1521*c* may radially extend from a periphery of the first cap support protrusion 1521*b*. The cap fixing protrusion 1521*c* may have a cuboid shape that extends long in the radial direction so as to correspond to the cap fixing groove 111*c* of the base shell 111. As the cap fixing protrusion 1521*c* is radially supported by being inserted into the cap fixing groove 111*c*, the support spring 151 may be provided in an inclined manner. Even when the cap fixing protrusion 1521*c* and the cap fixing groove 111*c* receive a resultant force acting in the axial direction and the radial direction, this force may be smoothly countered, canceled, or offset, and the compressor body C may be securely supported.

Figure 5:
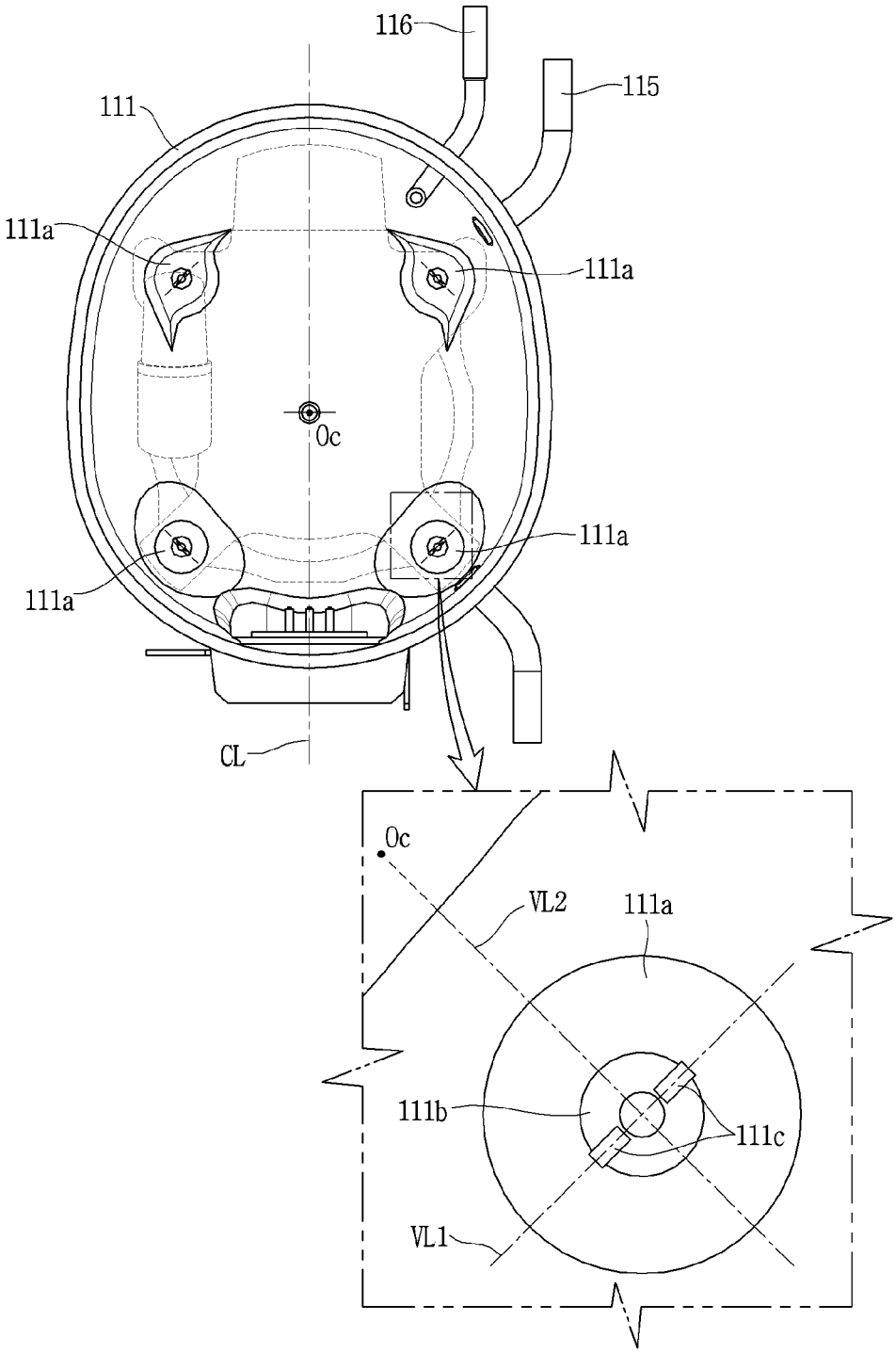
FIG. 5 is a planar view of a bottom surface of a base shell for showing an example of a provided state of a cap fixing groove in FIG. 1.

Further, the cap fixing protrusions 1521*c* may be provided radially from the center Oc of the compressor body C (or a center of four cap mounting surfaces), as illustrated in FIG. 5. For example, the cap fixing protrusion 1521*c* may be formed on both sides of the first cap support protrusion 1521*b*, and the two cap fixing protrusions 1521*c* may be elongated in a direction orthogonal to an inclined direction of the support spring 151. A virtual line that passes through the two cap fixing protrusions 1521*c* may be referred to as a 'first virtual line VL1' and a virtual line that passes through the center Oc of the compressor body C at a center between the two cap fixing protrusions 1521*c* may be referred to as a 'second virtual line VL2.' The second virtual line VL2 may be formed in a direction orthogonal to the first virtual line VL1.

Vibration of the compressor body C may be evenly distributed to the cap fixing protrusions 1521*c* to thereby securely support the compressor body C. As the cap fixing protrusions 1521*c* are formed at the four corners of the compressor body C, the compressor body C may be supported in all directions, allowing the compressor body C to be securely supported.

Figure 6:
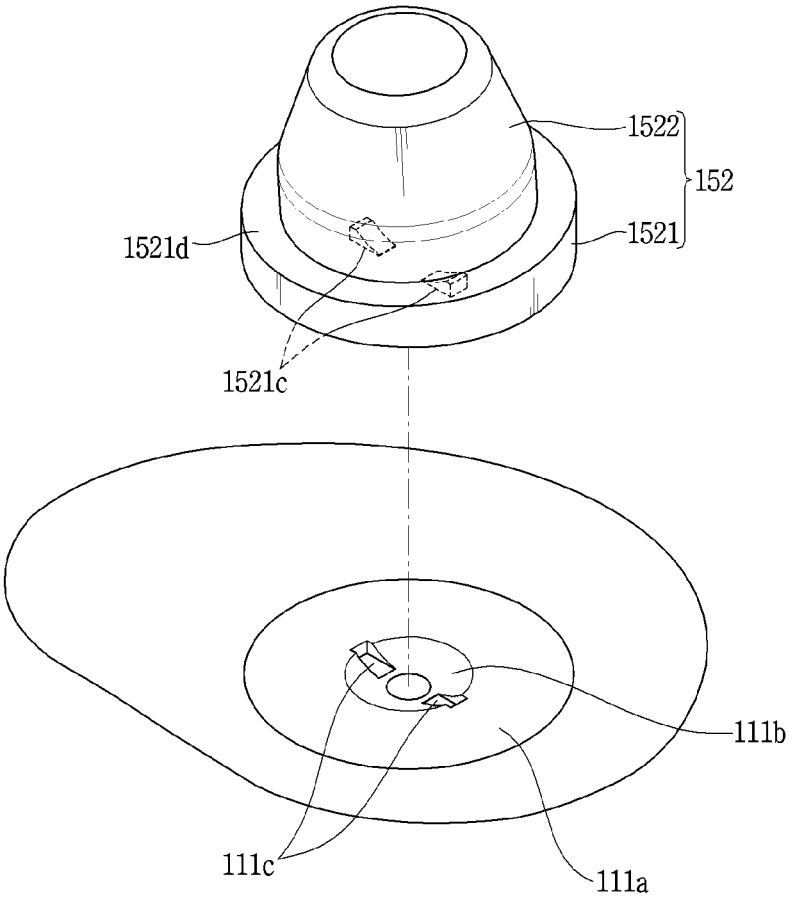
FIG. 6 is a perspective view illustrating an assembled state of a first spring cap in FIG. 1.
Figure 7:
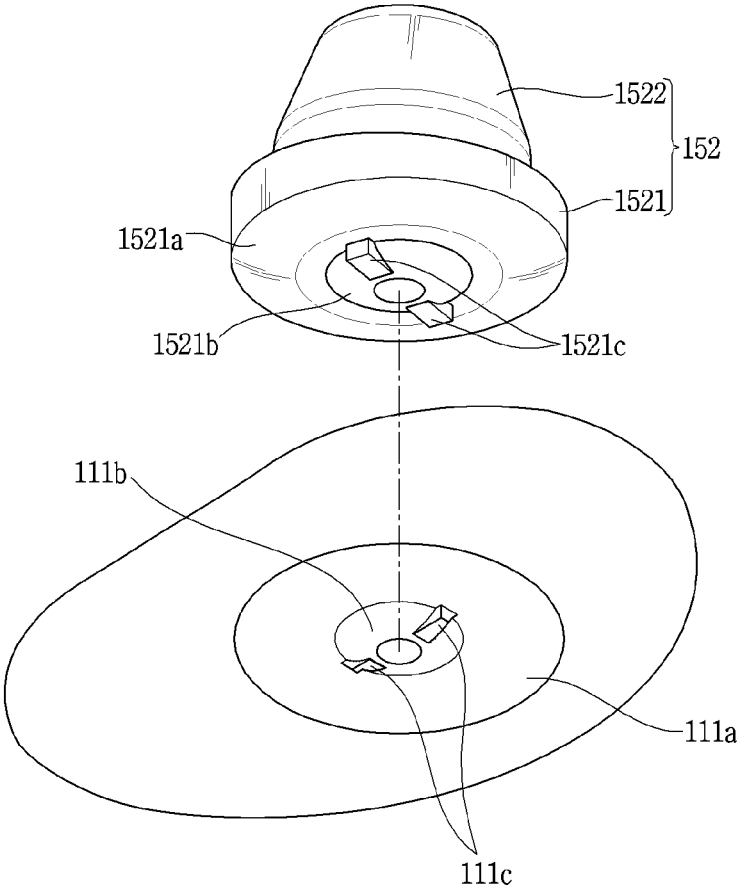
FIG. 7 is a disassembled perspective view of the first spring cap in FIG. 6.
Figure 8:
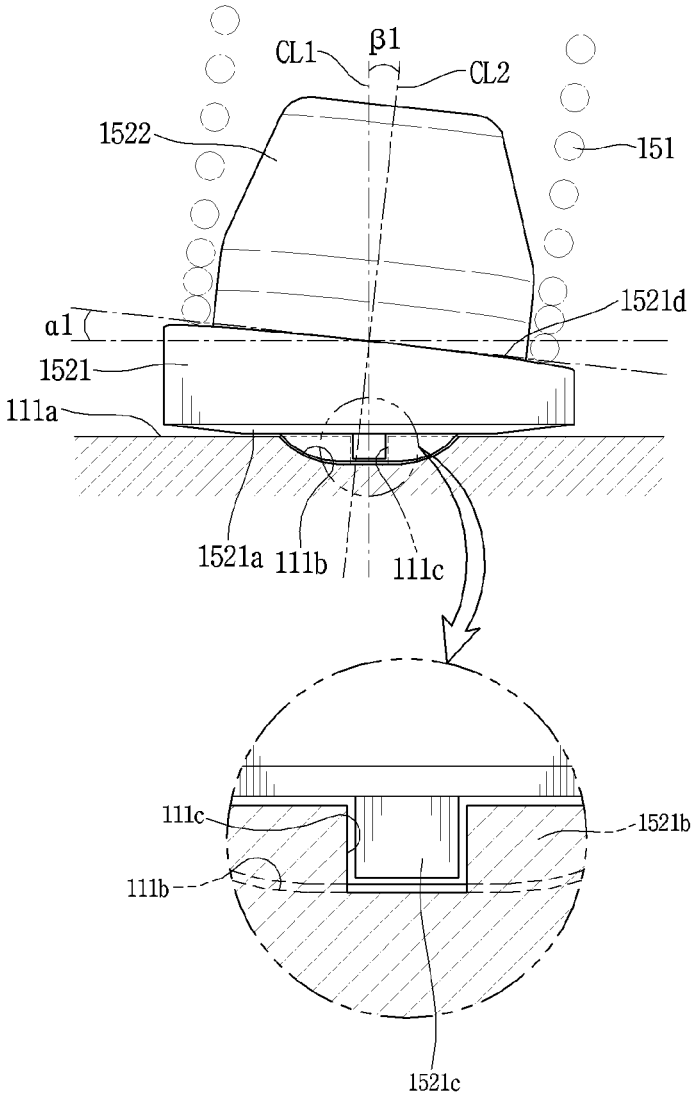
FIG. 8 is a front view of the first spring cap in FIG. 6.

Referring to FIGS. 6 to 8, a first spring support surface 1521*d* with which the lower end of the support spring 151 is in close contact may be formed on an upper surface of the first spring support portion 1521. The first spring support surface 1521*d* may be formed in an annular shape along a circumference of the first spring insertion portion 1522.

In addition, an outer diameter of the first spring support portion 1521, (i.e., an outer diameter of the first spring support surface 1521*d*) may be greater than or equal to an outer diameter of the support spring 151. The lower end of the support spring 151 may be axially supported by being in close contact with the upper surface of the first spring support portion 1521 (i.e., the upper surface of first spring support surface 1521*d*).

The first spring support surface 1521*d* may be formed as an inclined surface that is inclined with respect to the cap mounting surface 111*a* of the base shell 111, i.e., an inclined surface tilted by a predetermined inclination angle with respect to the axial direction (hereinafter, "first support surface inclination angle") $\alpha 1$. The support spring 151 may be provided to be inclined with respect to the cap mounting surface 111*a* by the first support surface inclination angle $\alpha 1$, and the first spring support surface 1521*d* may axially and radially support the lower end of the support spring 151.

The first spring support surface 1521*d* may gradually decrease in height toward the center Oc of the compressor body C. A thickness of the first spring support portion 1521 may vary along a circumferential direction, which may be the lowest in a direction toward the center Oc of the compressor body C and be the highest in a direction opposite thereof. A lower end of the support spring 151 that is in close contact with the first spring support surface 1521*d* may be fixed by being tilted toward the center Oc of the compressor body C by a predetermined angle. The lower end of each of the support springs 151 may be uniformly supported on the first spring support surface 1521*d* of one of the first spring caps 152 while allowing the support springs 151 to be provided in an inclined manner.

Referring to FIG. 8, the first spring insertion portion 1522 may extend toward a second spring insertion portion 1532 described hereinafter from the upper surface of the spring support portion 1521, namely, a central portion of the first spring support surface 1521*d*. The first spring insertion portion 1522 may have a cylindrical shape or a truncated cone shape that becomes narrower toward a top.

The first spring insertion portion 1522 may be inclined in a direction toward the center Oc of the compressor body C. For example, when a virtual line that passes through a center of the first spring support portion 1521 is referred to as a 'first center line CL1' and a virtual line that passes through a center of the first spring insertion portion 1522 is referred to as a 'second center line CL2,' the first center line CL1 may be inclined with respect to the second center line CL2 by a predetermined inclination angle (hereinafter, "first insertion portion inclination angle") $\beta 1$.

Here, the first insertion portion inclination angle β1 at which the first spring insertion portion 1522 is inclined with respect to the axial direction (longitudinal direction) may be substantially the same as the first support surface inclination angle α1 at which the first spring support surface 1521*d* is inclined with respect to the radial direction (transverse direction). The first spring insertion portion 1522 may be orthogonal to the first spring support surface 1521*d*. The lower end of the support spring 151 may be inserted into the second spring insertion portion 1522 in an inclined manner without causing warping (or twist) of the support spring 151.

As the support spring 151 radially and axially supports the compressor body C while being tilted to the second spring support surface 1521*d*, support stability of the support spring 151 may be increased. The support spring 151 may be provided in an inclined manner without causing interference with the spring insertion portion 1522 when the support spring 151 is stretched or compressed, enhancing reliability of the hermetic compressor.

Figure 9:
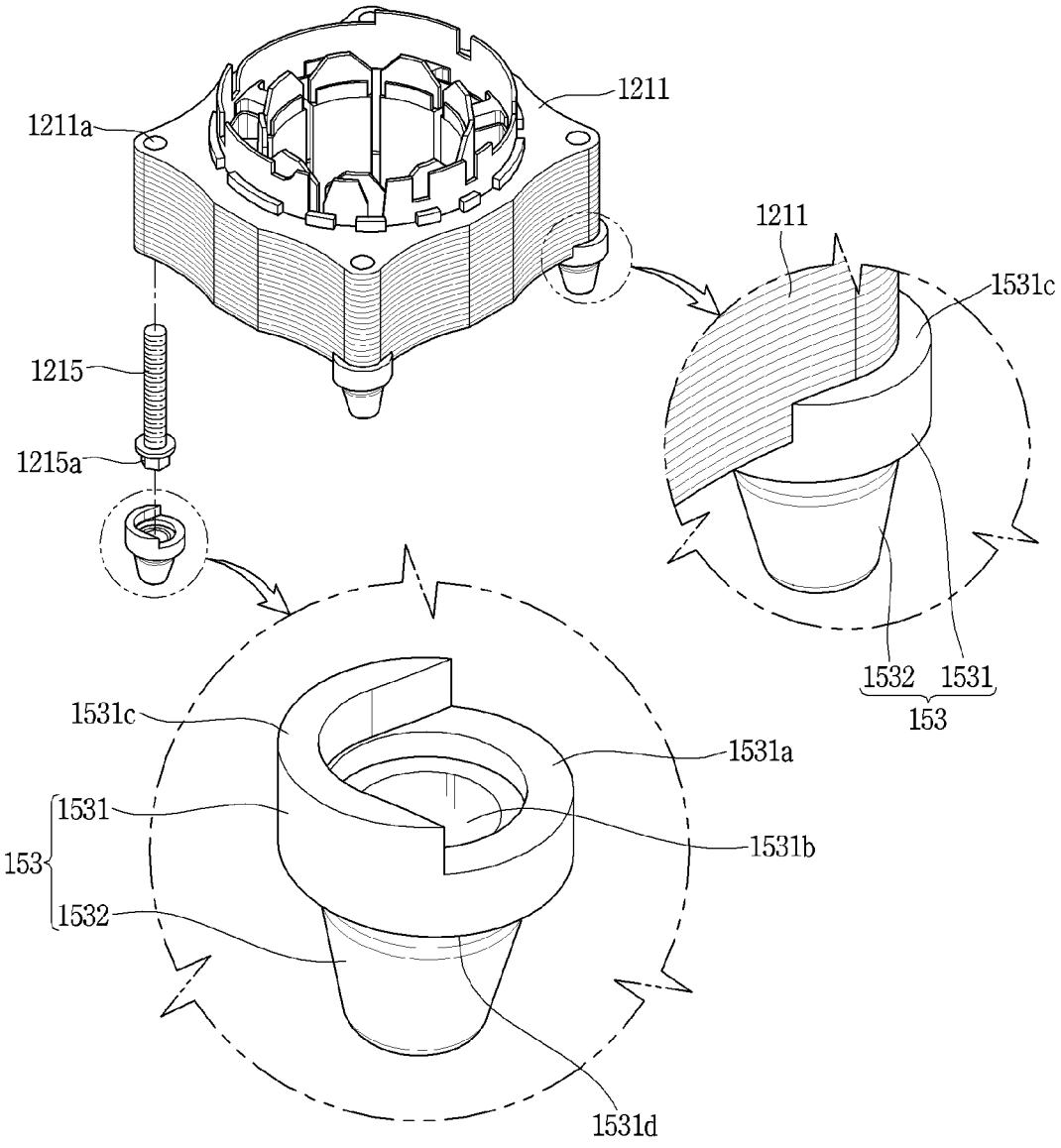
FIG. 9 is a perspective view illustrating an assembled state of a second spring cap in FIG. 1.
Figure 10:
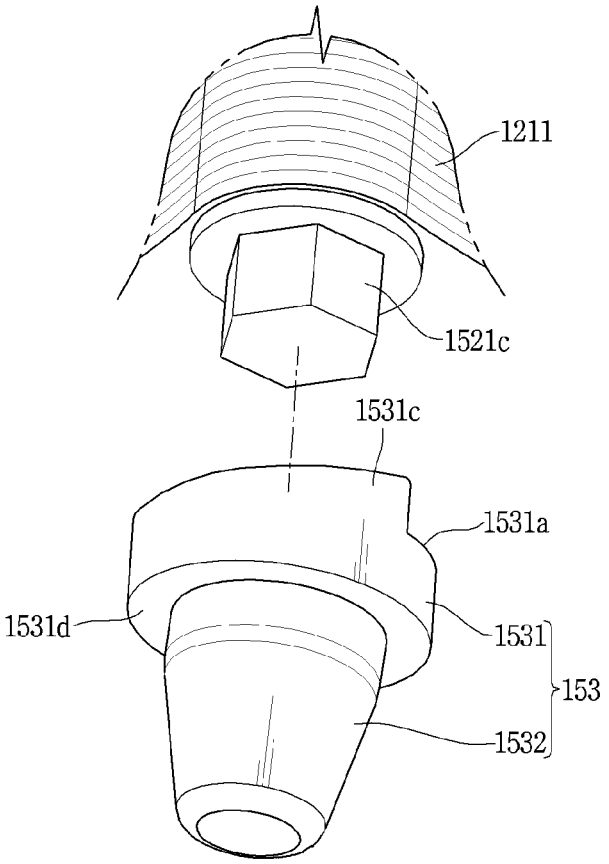
FIG. 10 is a disassembled perspective view of the second spring cap in FIG. 9.
Figure 11:
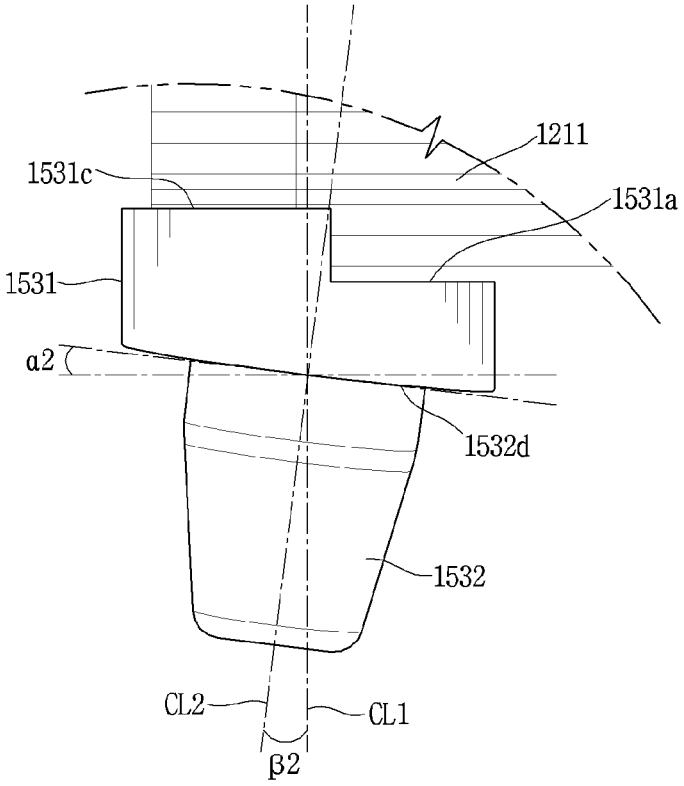
FIG. 11 is a front view of the second spring cap in FIG. 9.

Hereinafter, the second spring cap 153 will be described. As illustrated in FIGS. 9 to 11, the second spring cap 153 may have a shape of an inverted first spring cap 152. For example, the second spring cap 153 may include a second spring support portion 1531 and the second spring insertion portion 1532. The second spring cap 153 may be made of an elastic material, such as a rubber and plastic material.

The second spring support portion 1531 may have a disk shape. A second cap fixing surface 1531*a*, which may be part of an upper surface of the second spring support portion 1531, may be fixed to the compressor body C by being brought into close contact with the lower surface of the stator core 1211 that defines the lower surface of the compressor body C.

A bolt insertion groove 1531*b* may be formed at a central portion of the second cap fixing surface 1531*a*. An inner circumferential surface of the bolt insertion groove 1531*b* may have an angular shape so as to correspond to an outer circumferential surface of the bolt head portion 1215*a*. The second spring cap 153 may be inserted into and coupled to the bolt head portion 1215*a* of the stator fastening bolt 1215 that penetrates through the stator core 1211.

The second spring support portion 1531 may be provided with a second cap support protrusion 1531*c* formed at an edge of the second cap fixing surface 1531*a* along an edge of the second spring support portion 1531. The second cap supporting protrusion 1531*c* may be provided only on a portion of the edge of the second cap fixing surface 1531*a* that corresponds to an edge of the stator core 1211. The second cap support protrusion 1531*c* may be formed in an arcuate shape that protrudes in the axial direction so as to be fixed by covering the edge of the stator core 1211.

A second spring support surface 1531*d* may be formed at a lower surface of the second spring support portion 1531. Like the first spring support surface 1521*d*, the second spring support surface 1531*d* may be formed in an annular shape along a circumference of the second spring insertion portion 1532.

An outer diameter of the second spring support portion 1531 may be greater than or equal to an outer diameter of the support spring 151. The upper end of the support spring 151 externally inserted into the second spring insertion portion 1532 may be brought into close contact with the second spring support surface 1531*d* formed on the lower surface of the second spring support portion 1531 to be fixed.

The second spring support surface 1531*d* may be symmetrical to the first spring support surface 1521*d*. For example, the second spring support surface 1531*d* may be formed as an inclined surface that is inclined with respect to the lower surface of the stator core 1211 by a predetermined inclination angle (hereinafter, "second support surface inclination angle") α2. The second support surface inclination angle α2 of the second spring support surface 1531*d* and the first support surface inclination angle α1 of the first spring support surface 1521*d* may be equal or identical in opposite directions.

The second spring support surface 1531*d* may increase in height toward the center Oc of the compressor body C. A thickness of the second spring support portion 1531 may vary along the circumferential direction, which may be highest in a direction toward the center Oc of the compressor body C and be lowest in a direction opposite thereof.

An upper end of the support spring 151 that is in close contact with the second spring support surface 1531*d* may be fixed by being tilted toward the Oc of the compressor body C with respect to the lower surface of the stator core 1211 by the second support surface inclination angle α2. The upper end of each of the support springs 151 may be uniformly supported on the second spring support surface 1531*d* of one of the second spring caps 153 while allowing the support springs 151 to be provided in an inclined manner.

Referring to FIG. 11, the second spring insertion portion 1532 may be symmetrical to the first spring insertion portion 1522. For example, the second spring insertion portion 1532 may extend toward the first insertion portion 1522 from a central portion of the second spring support surface 1531*d*. The second spring insertion portion 1532 may have a cylindrical shape or a truncated cone shape that becomes narrower toward a top.

The second spring insertion portion 1532 may be inclined in a direction away from the center Oc of the compressor body C. An inclination angle at which the second spring insertion portion 1532 is inclined with respect to the axial direction (longitudinal direction) (hereinafter, "second insertion portion inclination angle") β2 may be substantially the same as the second support surface inclination angle α2 at which the second spring support surface 1531*d* is inclined with respect to the radial direction (transverse direction). The second spring insertion portion 1532 may be formed such that a second center line CL2 passing through a center of the second spring insertion portion 1532 is tilted with respect to a first center line CL1 passing through a center of the second spring support portion 1531 by the second insertion portion inclination angle β2.

The second spring insertion portion 1532 may be orthogonal to the second spring support surface 1531*d* that is inclined by the second support surface inclination angle α2, allowing the lower end of the support spring 151 to be inserted into the second spring insertion portion 1532 in an inclined state.

The support spring 151 may radially and axially support the compressor body C when the support spring 151 is inclined outwardly toward a bottom of the second spring support surface 1531*d*. Support stability of the support spring 151 may be increased. The support spring 151 may be provided in an inclined manner without causing interference with the spring insertion portion 1532 when the support spring 151 is stretched and compressed, allowing reliability of the compressor to be increased.

As the plurality of support springs 151, which may be configured as compression coil springs, are inclined, stiffness in the longitudinal direction (hereinafter, "longitudinal stiffness") of the support spring 151 may be transferred to stiffness in the transverse direction (hereinafter, "transverse stiffness"). Radial support for the compressor body C may be reinforced to thereby effectively suppress transverse vibration of the compressor body C generated during stop/start, inclined operation, or transport of the compressor.

Figure 12:
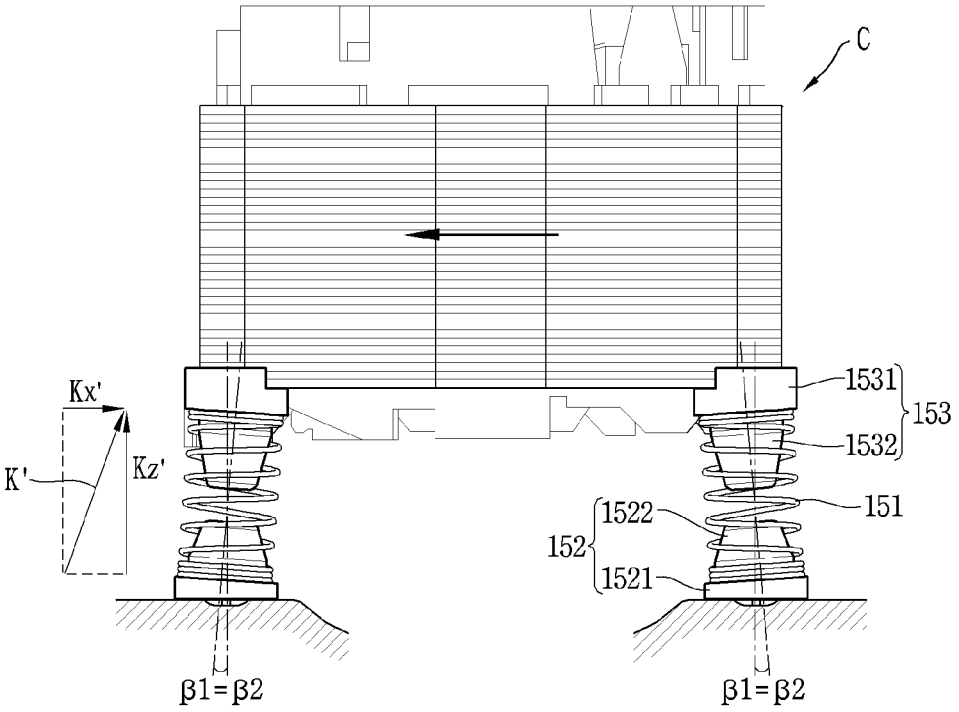
FIG. 12 is a schematic view of a support part in FIG. 1 from a lateral (side) direction for explaining the effects of amplitude reduction.

Referring to FIG. 12, as each of the plurality of support springs 151 that supports the compressor body C is inclined by a predetermined angle, transverse stiffness may be added to thereby increase stiffness of the support springs 151. For example, when the compressor body C vibrates in the transverse direction, which is indicated by an arrow in the drawing, transverse stiffness Kx' in addition to longitudinal stiffness Kz' are provided in the support spring 151. A component force of the longitudinal stiffness Kz' may be transferred to the transverse stiffness Kx' to thereby generate spring stiffness K' that corresponds to a resultant force of the longitudinal stiffness Kz' and the transverse stiffness Kx'. This may be equally applied when the compressor body C vibrates in a transverse direction opposite to the arrow direction in the drawing.

Even when the compressor body C vibrates in the transverse direction, transverse amplitude of the compressor body C may be effectively limited or restricted due to the reinforced transverse stiffness of the support spring 151. As the cylinder cover 1414 is located further away from the center Oc of the compressor body C relative to other members, the cylinder cover 1414 may be highly likely to collide with the inner surface of the shell 110 when transverse vibration of the compressor body C is increased, for example, during stop/restart, inclined operation, or transport of the compressor.

However, as the transverse stiffness of the support spring 151 that supports the compressor body C is provided, a possibility of colliding with the cylinder cover 1414 that defines a portion of the compressor body C may be reduced. Or even if a collision occurs, its collision force may be reduced. Vibration noise of the compressor body C may be reduced while suppressing damage caused by a collision between the compressor body C and the shell 110, increasing reliability of the hermetic compressor. As the amplitude of the compressor body C is attenuated by using the support spring 151 that supports the compressor body C with respect to the shell 110, vibration of the hermetic compressor may be reduced without any additional component or device required, to reducing manufacturing costs of the hermetic compressor.

Figure 13:
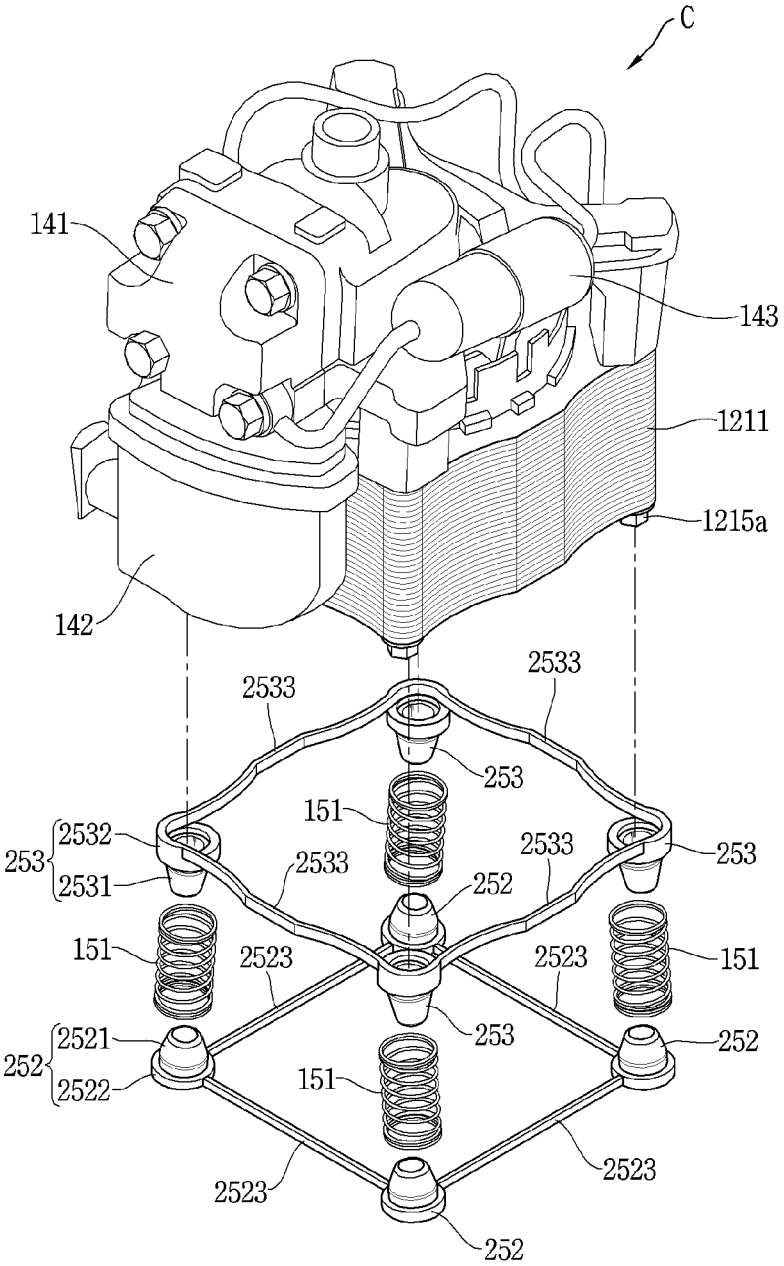
FIG. 13 is an exploded perspective view illustrating an example of a support part.
Figure 14A:
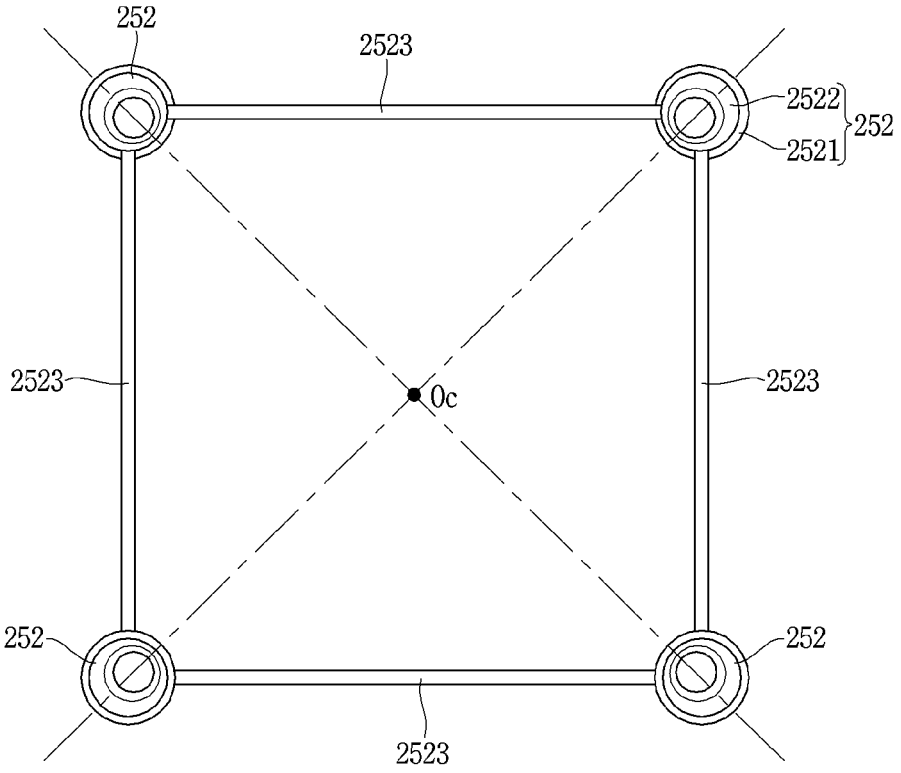
FIG. 14A is a planar view and FIG. 14B is a side view respectively illustrating a first spring cap in FIG. 13.
Figure 14B:
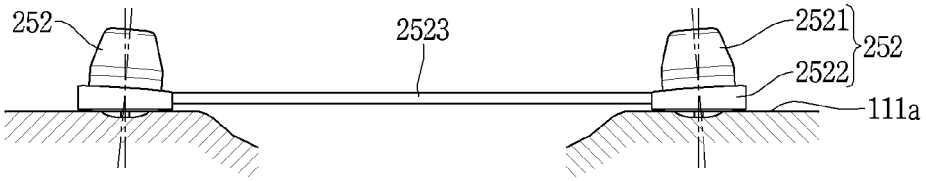
Figure 15A:
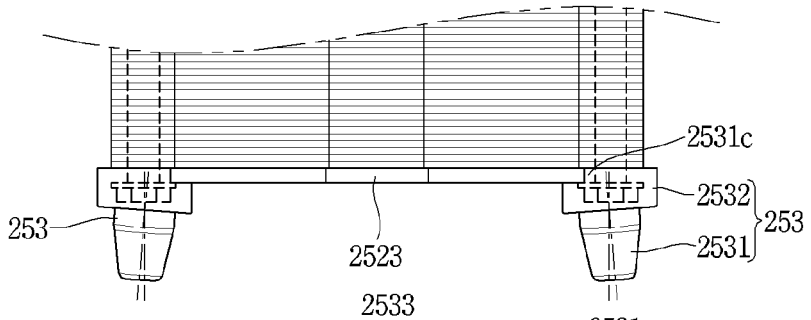
FIG. 15A is a side view and FIG. 15B is a planer view respectively illustrating a second spring cap in FIG. 13.
Figure 15B:
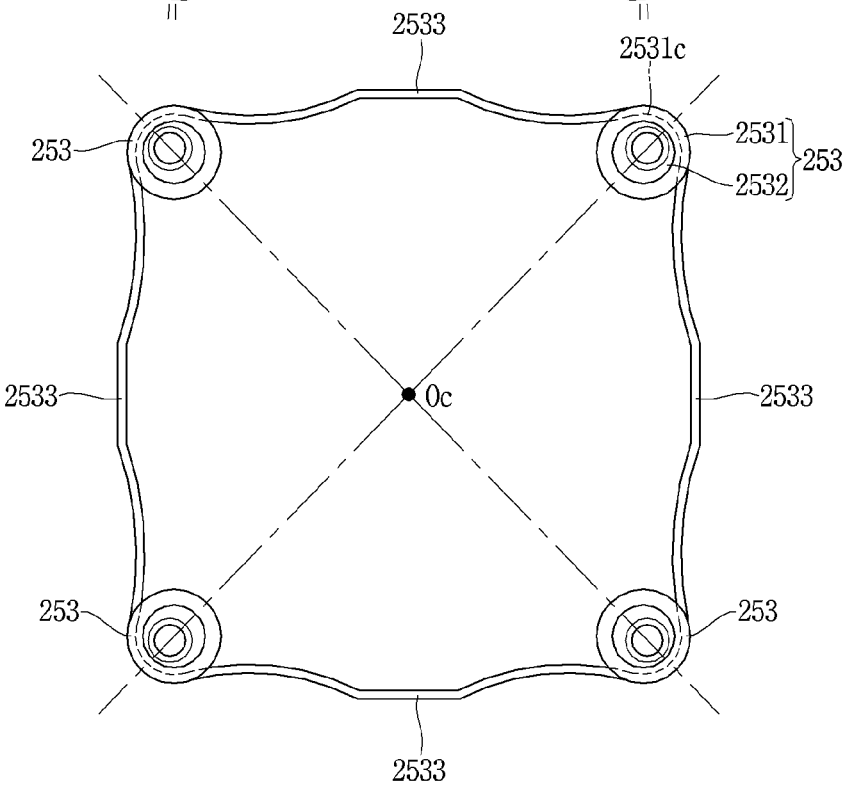

Hereinafter, a description will be given of another example of a support. In the example described above, a plurality of first spring caps and a plurality of second spring caps may be individually or separately provided, but in another embodiment, the plurality of first spring caps and the plurality of second spring caps may be connected to one another. Referring to FIGS. 13 to 15, a first spring cap 252 of this example may be provided in plurality, and the plurality of first spring caps 252 may be connected together by first cap connecting frame 2523.

Since the first spring cap 252 may be substantially the same as the first spring cap 152 of the previous example of FIG. 8, a detailed description thereof will be omitted here. In some implementations, a first spring support surface 2521*d* may be formed on an upper surface of a first spring support portion 2521 that defines the first spring cap 252. The first spring support surface 2521*d* may be inclined with respect to the cap mounting surface 111*a* of the base shell 111 by a predetermined angle α1, which may be referred to as a 'first support surface inclination angle.'

A first spring insertion portion 2522 that defines the first spring cap 252 may be inclined with respect to the cap mounting surface 111*a* of the base shell 111 by a predetermined inclination angle β1, which may be referred to as a 'first insertion portion inclination angle.'

The first insertion portion inclination angle β1 may be equal to the first support surface inclination angle α1, and the first spring insertion portion 2522 may be orthogonal to the first spring support surface 2521*d*. However, in the example described above, the first spring caps 152 may be individually provided on the cap mounting surface 111*a* to be spaced apart from one another other, but the plurality of first spring caps 252 of this example may be collectively provided on the cap mounting surface 111*a* by being connected to each other.

For example, one end of a first cap connector or frame 2523 may extend from an outer circumferential surface of one of the first spring support portions 2521, each defining a portion of one of the first spring caps 252, and another end of the first cap connecting 2523 may be connected to an outer circumferential surface of another one of the first spring support portions 2521 located adjacent thereto. The plurality of first spring caps 252 may be connected to one another by the first cap connectors 2523 having a square strip shape. When assembling the plurality of first spring caps 252 to the base shell 111, the plurality of first spring caps 252 may be collectively assembled.

A second spring cap 253 of this example may be similar to the first spring cap 252. The second spring cap 253 may be provided in plurality, and the plurality of second spring caps 253 may be connected together by second cap connectors 2533. The second spring caps 253 may be substantially the same as the second spring caps 153 of the previous example of FIG. 11, so a detailed description thereof will be omitted here.

In some implementations, a second spring support surface 2531*d* may be formed on an upper surface of a second spring support portion 2531 that defines the second spring cap 253. The second spring support surface 2531*d* may be inclined with respect to the cap mounting surface 111*a* of the base shell 111 by a predetermined inclination angle α2, which may be referred to as a 'second support surface inclination angle.'

A second spring insertion portion 2532 that defines the second spring cap 253 may be inclined with respect to the cap mounting surface 111*a* of the base shell 111 by a predetermined inclination angle β2, which may be referred to as a 'second insertion portion inclination angle.' The second insertion portion inclination angle β2 may be equal to the second support surface inclination angle α2 and the second spring insertion portion 2532 may be orthogonal to the second spring support surface 2531*d*.

However, in the example described above, the second spring caps 153 may be individually provided on the cap mounting surface 111*a* to be spaced apart from one another other, but the plurality of first spring caps 253 of this example may be collectively provided on the cap mounting surface 111*a* by being connected to each another. For example, as for the plurality of the second spring caps 253, one end of the second cap connecting 2533 may extend from an outer circumferential surface of one of the second spring support portions 2531, each defining a portion of one of the second spring cap 253. One end of a second cap connector or frame 2533 may extend from an end of one of the cap fixing protrusions 2531*c* of the second spring portions 2531, and another end of the second cap connector 2533 may be connected to an end of another one of the cap fixing protrusions 2531*c* located adjacent thereto.

The plurality of second spring caps 253 may be connected together by the second cap connectors 2533 having a square strip shape. The plurality of second spring caps 253 may be connected to one another by the second cap connectors 2533 to thereby form a sort of modularized second spring cap. When assembling the plurality of second spring caps 253 to the compressor body C, the plurality of second spring caps 253 may be assembled collectively or at once, allowing an assembly process to be simplified.

Figure 16:
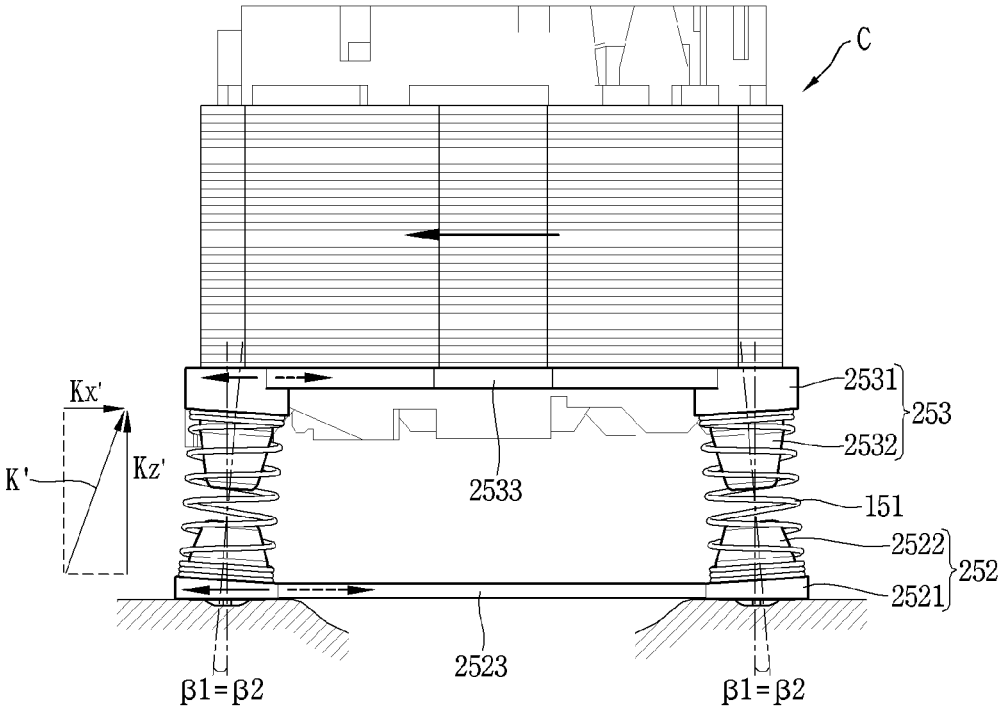
FIG. 16 is a schematic view of the support part in FIG. 13 from a lateral (side) direction for explaining its effects.

Referring to FIG. 16, as the plurality of first spring caps 252 and the plurality of second spring caps 253 of this example are provided in an inclined manner, as the example described above, longitudinal stiffness Kz' and transverse stiffness Kx' may be provided in each of the support springs 151. This may allow transverse amplitude of the compressor body C to be effectively reduced, as in the example of FIG. 12.

However, the plurality of the first spring caps 252 and the plurality of second spring caps 253 of this example may be connected to each other by the first cap connectors 2523 and the second cap connectors 2533, respectively. The first spring caps 252 may be mutually constrained with each other, and the second spring caps 253 may be mutually constrained with each another. This may prevent the first spring caps 252 and the second spring caps 253 from being pushed in the radial direction, allowing the first spring caps 252 and the second spring caps 253 to be more firmly fixed.

When the compressor body C vibrates in a left direction of the drawing, force is applied to the first spring cap 252 and the second spring cap 253 in the left direction of the drawing represented by a solid line arrow. Accordingly, the first spring cap 252 or the second spring cap 253 may receive force in a direction in which the first spring cap 252 or the second spring cap 253 is separated from the base shell 111 or the compressor body C.

However, when the plurality of first spring caps 252 are connected together by the first cap connectors 2523, and the plurality of second spring caps 253 are connected together by the second cap connectors 2533, the force acted in the separation direction of the first spring cap 252 may be offset by the first cap connectors 2523 as shown by a dotted line arrow, and the force acted in the separation direction of the second spring cap 253 may be offset by the second cap connectors 2533.

The support springs 151 may securely support the compressor body C by being provided in an inclined manner while effectively suppressing separation of the first spring caps 252 and the second spring caps 253 from respective fixed surfaces. Although not illustrated in the drawings, one of the first spring caps and the second spring caps may be individually provided, and the other spring caps may be connected together by the cap connectors. Its basic structure and operating effects are the same or similar to those of the examples described above, and thus a detailed description thereof will be omitted.

Hereinafter, a description will be given of an example of a cap fixing groove. In the example described above, the cap fixing grooves respectively provided on both sides of each cap mounting surface may be radially provided with respect to the center of the compressor body, but in some cases, the cap fixing grooves may be arranged in parallel.

Figure 17:
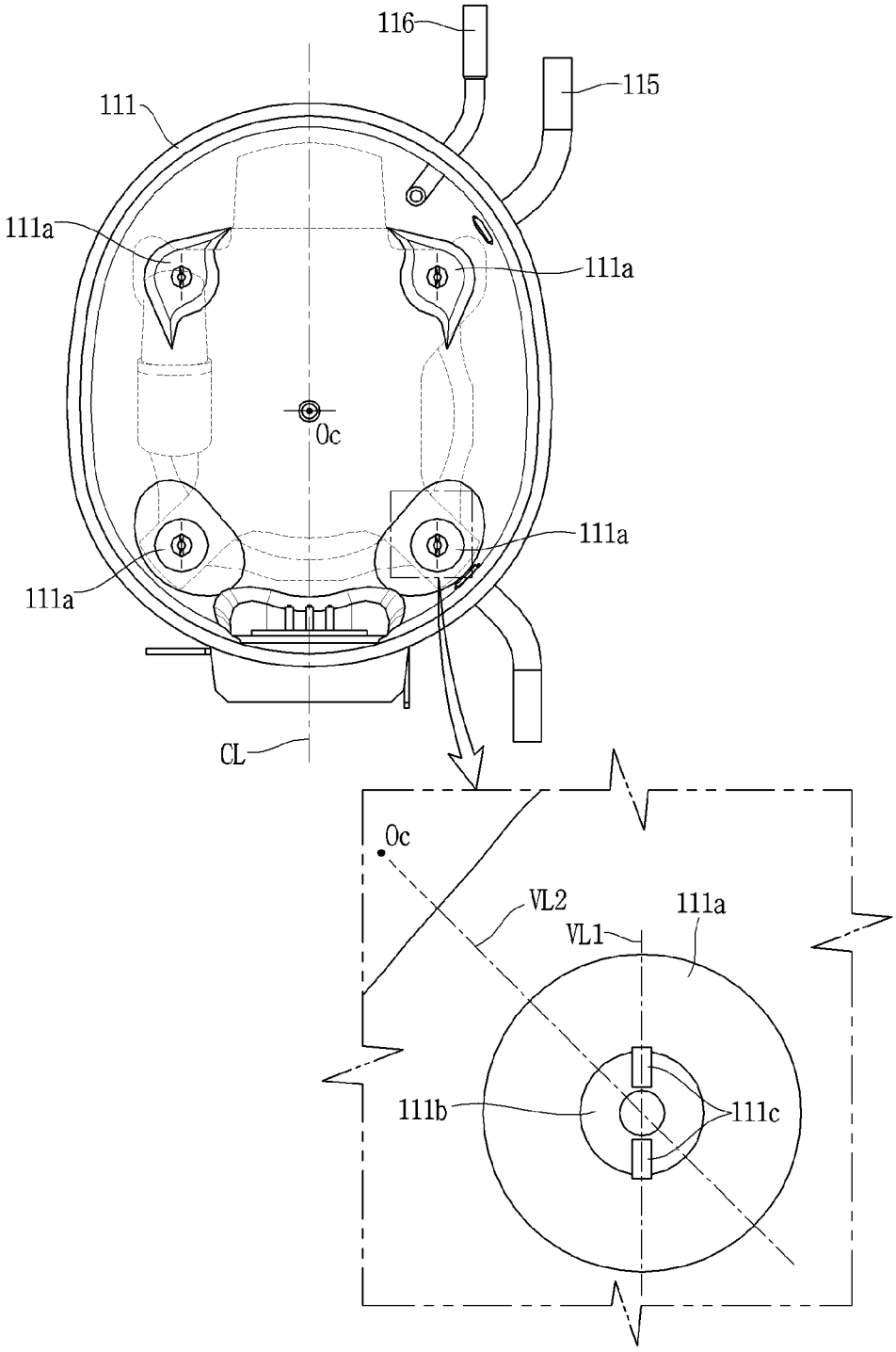
FIG. 17 is a planar view of a bottom surface of a base shell for showing an example of a provided state of a cap fixing groove in FIG. 1.

Referring to FIG. 17, a plurality of cap fixing grooves 111*c* respectively provided on both sides of one cap mounting groove 111*b* in the cap mounting surface 111*a* may be provided to be parallel to a plurality of cap fixing grooves 111*c* provided on another cap mounting surface 111*a* located adjacent thereto. For example, the plurality of cap fixing grooves 111*c* may be elongated along a center line CL in a reciprocating direction of the piston 132. A first virtual line VL1 that passes through the plurality of cap fixing grooves 111*c* may be parallel to the center line CL in the reciprocating direction of the piston 132.

The cap fixing protrusion 1521*c* may be parallel to a side surface of the stator core 1211 and/or the compressor body C. As the cap fixing protrusions 1521*c* respectively formed on both sides of the first cap support protrusion 1521*b* correspond to the cap fixing grooves 111*c*, respectively, the cap fixing protrusions 1521*c* may also be provided to be parallel to the center line CL in the reciprocating direction of the piston 132 the same as that of the cap fixing grooves 111*c*.

When the cap fixing grooves 111*c* are provided to be parallel to the center line CL in the reciprocating direction of the piston 132, the first spring support surface 1521*d* and the second spring support surface 1531*d* may also be inclined in a direction orthogonal to the center line CL in the reciprocating direction of the piston 132. Even in this case, the effects may be substantially similar to that of the example described above. Intervals between the plurality of support springs 151 may increase toward the cap mounting surfaces 111*c* to thereby increase transverse stiffness of each of the support springs 151, allowing the compressor body C to be effectively supported. In this example, as the support springs 151, the first spring caps 152, and the second spring caps 153 are provided to be parallel to one another, manufacturing and assembly processes of the support parts 150 including them may be simplified.

Embodiments disclosed herein may provide a hermetic compressor that can reduce transverse amplitude of a compressor body that is elastically supported on a shell. Embodiments disclosed herein may provide a hermetic compressor that can reduce transverse amplitude of a compressor body itself without installing an additional damping member (or stopper member) between a shell and the compressor body.

Embodiments disclosed herein may provide a hermetic compressor that can reduce transverse amplitude by increasing transverse stiffness of a support member that elastically supports a compressor body, and can suppress a collision between a shell and the compressor body without installing an additional damping member (or stopper member). Embodiments disclosed herein may provide a hermetic compressor that can reduce transverse amplitude of a compressor body that is elastically supported on a shell while achieving support stability of a support member.

Embodiments disclosed herein may provide a hermetic compressor that can allow a support member to be securely supported by forming a cross section of a spring that supports a compressor body and a cross section of a spring cap that faces the cross section of the spring, or an inner circumferential surface of a shell to which the spring cap is directed or a lower surface of the compressor body to be orthogonal to a lengthwise direction of the support member.

Embodiments disclosed herein may provide a hermetic compressor that can securely support a compressor body by suppressing an end of a spring that supports the compressor body from being pushed. Embodiments disclosed herein may provide a hermetic compressor that can securely maintain a distance between one spring cap provided at an end of a spring that supports a compressor body and another spring cap located adjacent thereto.

Embodiments disclosed herein may provide a hermetic compressor that can allow a compressor body to be elastically supported on a shell while reducing the shell in size. Embodiments disclosed herein may provide a hermetic compressor that can achieve a small-sized shell by reducing a gap or interval between a compressor body and a shell without installing an additional damping member (or stopper member) between the shell and the compressor body. Embodiments disclosed herein may provide a hermetic compressor that can reduce transverse amplitude of a compressor body by using an existing part (or component) without installing an additional damping member (or stopper member) between a shell and the compressor body, thereby reducing manufacturing costs of a compressor and achieving a small-sized shell.

Embodiments disclosed herein may be implemented as a hermetic compressor which includes a plurality of support springs that supports a compressor body downward and is installed in an inclined manner. This may allow longitudinal stiffness of the support springs to be transferred to transverse stiffness to thereby reduce transverse displacement of the support springs. As transverse amplitude itself is reduced, no damping member (or stopper member) may be required between a shell and a compressor body. This may result in reducing manufacturing costs and achieving a small-sized shell.

Embodiments disclosed herein may include one or more of the following features. For example, a plurality of first spring caps installed on a bottom surface of a shell, a plurality of second spring caps installed on a lower surface of a compressor body that faces the bottom surface of the shell, and a plurality of support springs having both ends thereof coupled to the plurality of the first spring caps and the plurality of second spring caps may be provided. Intervals between the first spring caps may be greater than intervals between the second spring caps. Accordingly, intervals between the support springs may increase toward lower ends thereof to thereby support the compressor body in a more secure manner.

Embodiments disclosed herein may have a plurality of support springs that supports a compressor body downward and is provided in an inclined manner, and a plurality of spring caps inserted into both ends of the plurality of support springs may be provided. A cap fixing protrusion or a cap fixing groove may be formed between the plurality of spring caps and a member to which the spring caps are fixed, and the cap fixing protrusion or the cap fixing groove may be elongated in a direction orthogonal to an inclined direction of the support spring. Accordingly, axial and radial directions of the support springs may be securely supported when the support springs are provided in an inclined manner.

Embodiments disclosed herein may provide a plurality of support springs which may be provided with a plurality of first spring caps and a plurality of second spring caps on both ends thereof. At least either the first spring caps or the second spring caps may be connected together. Thus, assembly of the plurality of spring caps may be simplified while allowing the plurality of spring caps to be more securely fixed.

Embodiments disclosed herein may be implemented as a hermetic compressor including a shell that defines an outer appearance, a compressor body that is provided to be spaced apart from an inner surface of the shell and includes a motor unit and a compression unit, a plurality of support springs that is provided between the shell and the compressor body and elastically supports the compressor body with respect to the shell, and a plurality of spring caps fixed to the inner surface of the shell and the compressor body that faces the inner surface of the shell, respectively, so as to support both ends of each of the plurality of support springs. Each of the plurality of support springs may be provided to be inclined with respect to an axial direction. This may allow longitudinal stiffness of the support springs to be transferred to transverse stiffness to thereby increase a transverse support force of the support springs. Thus, movement or shaking of the compressor body during stop/start or transport of the compressor may be suppressed or reduced.

Implementations according to this aspect may include one or more of the following features. For example, each of the spring caps may include a spring support portion fixed to the inner surface of the shell or the compressor body to support an end of one of the support springs, and a spring insertion portion that extends from the spring support portion so as to allow one of the support springs to be inserted therein. A second center line that passes through a center of the spring insertion portion may be inclined with respect to a first center line that passes through a center of the spring support portion. Accordingly, the support springs may be provided in an inclined manner without causing warping (or twist) of the support springs to thereby increase support stability. Further, interference with the spring insertion portions may be prevented when the support springs are compressed and stretched (or released) to thereby enhance reliability.

In some implementations, each of the spring caps may include a spring support portion fixed to the inner surface of the shell or the compressor body to support an end of one of the support springs. Each of the spring support portions may have a spring support surface with which a cross section of one of the support springs is in contact, and the spring support surface may be inclined with respect to the axial direction.

In some implementations, the spring support surface may be orthogonal to a longitudinal center line of the spring insertion portion. This may allow the support springs to be smoothly compressed and stretched, and thus vibration of the compressor body may be effectively absorbed.

In some implementations, each of the spring caps fixed to the inner surface of the shell may be provided with at least one cap fixing protrusion formed on an opposite surface of the spring support surface, and the inner surface of the shell may be provided with a cap fixing groove in which the cap fixing protrusion is inserted. Accordingly, the support springs may be securely fixed while being provided in an inclined manner.

In some implementations, each of the cap fixing protrusions and the cap fixing grooves may be orthogonal to a direction in which one of the support springs is inclined. Accordingly, the support area may be increased with respect to a direction in which the resultant force is acted from an end of the support spring, allowing the support springs provided in the inclined manner may be securely supported.

In some implementations, the cap fixing protrusions and the cap fixing grooves may be radially provided with respect to a center of the compressor body, respectively. Accordingly, the compressor body may be securely supported in all directions.

In some implementations, the cap fixing protrusions and the cap fixing grooves may be provided to be parallel to each other, respectively. This may facilitate inclined installation of the support springs while effectively suppressing rotation of the compressor body.

In some implementations, each of the plurality of spring caps fixed to the compressor body may be provided with a cap support protrusion formed on a cap fixing surface that defines an opposite surface of the spring support surface, so as to cover a side edge of the compressor body. Accordingly, the spring caps fixed to the compressor body may be securely supported.

In some implementations, the cap support protrusion may be formed at an edge of the cap fixing surface and be provided therein with a bolt insertion groove formed in a recessed manner so as to allow a stator fastening bolt for fixing the motor unit to the compression unit to be inserted therein. Accordingly, the spring caps fixed to the compressor body may be easily fixed.

In some implementations, the plurality of support springs may be provided along a circumference of the compressor body to be spaced apart by predetermined intervals, and the plurality of support springs may be provided to be symmetrical to each other with respect to a center of the compressor body. This may allow transverse amplitude of the compressor body to be more effectively reduced.

In some implementations, intervals between the plurality of support springs may increase toward the shell. This may allow a transverse support force of the plurality of springs to be further increased.

In some implementations, a first fixing point may be radially eccentric with respect to a second fixing point when a point of each of the spring caps fixed to the inner surface of the shell is referred to as the first fixing point, and a point of each of the spring caps fixed to the compressor body is referred to as the second fixing point. Accordingly, intervals between the support springs may increase in a downward direction. Thus, a transverse support force of the plurality of springs may be increased while suppressing a longitudinal support force thereof from being reduced.

In some implementations, a first distance may be greater than a second distance when a radial distance from an axial center line of the compressor body to the first fixing point is referred to as the first distance, and a radial distance from the axial center line of the compressor body to the second fixing point is referred to as the second distance. In some implementations, the plurality of support springs may be provided along a circumference of the compressor body to be spaced apart by predetermined intervals, and the plurality of support springs may be provided to be symmetrical to each other with respect to a transverse center line of the compressor body. This may enable inclined placement of the plurality of support springs to be simplified while effectively reducing transverse amplitude of the compressor body.

Embodiments disclosed herein may be implemented as a hermetic compressor including a shell that defines an exterior or an outer appearance, a compressor body that is provided to be spaced apart from an inner surface of the shell and includes a motor unit and a compression unit, a plurality of support springs that is provided between the shell and the compressor body and elastically supports the compressor body with respect to the shell, and a plurality of spring caps fixed to the inner surface of the shell and the compressor body that faces the inner surface of the shell, respectively, so as to support both ends of each of the plurality of support springs. Each of the spring support caps may have a spring support surface with which a cross section of one of the support springs is in contact, and each of the spring support surfaces may be inclined with respect to an axial direction. Accordingly, inclined placement of the plurality of support springs may be simplified by using a shape of the spring caps.

Implementations according to this aspect may include one or more of the following features. For example, each of the spring support surfaces may be formed such that intervals between the plurality of support springs increase in a downward direction. Accordingly, the plurality of support springs may securely support the compressor body while being provided in an inclined manner.

In some implementations, the plurality of spring caps may be configured as a first spring cap fixed to the inner surface of the shell and a second spring cap fixed to the compressor body, and the first spring cap and the second spring cap may be provided in plurality, respectively, so as to be individually fixed to the inner surface of the shell or the compressor body. Accordingly, a degree of design freedom for each of the spring caps may be enhanced and the spring caps may be assembled easily as the spring caps are assembled individually or independently.

In some implementations, the plurality of spring caps may be configured as a plurality of first spring caps fixed to the inner surface of the shell and a plurality of second spring caps fixed to the compressor body, and at least one of the first spring caps and the second spring caps may be connected together. Accordingly, the spring caps may be constrained to each other. Thus, the support springs may be provided in an inclined manner while preventing a part of the spring caps from being separated or detached. In some implementations, at least one of the first spring caps and the second spring caps may be connected together by cap connecting parts extending therefrom.

Embodiments disclosed herein may be implemented as a hermetic compressor, comprising a shell, a compressor body spaced apart from an inner surface of the shell, the compressor body including a motor and a compression unit configured to compress a fluid via a driving force of the motor, wherein the compression unit may include a cylinder block and a piston, a plurality of springs provided between the shell and the compressor body to elastically support the compressor body with respect to the shell, a plurality of first caps fixed to the inner surface of the shell, and a plurality of second caps fixed to the compressor body. The plurality of first and second caps may be configured to support first and second ends, respectively, of each of the plurality of springs. Each of the plurality of springs may be inclined with respect to an axial direction of the compressor body.

Each of the first and second caps may include a spring base fixed to the inner surface of the shell or the compressor body to support an end of one of the springs, and a spring insert that extends from the spring base and configured to be inserted into the spring. The spring base and spring insert may be inclined with respect to each other such that a first center line passing through a center of the spring base may be inclined with respect to a second center line.

Each of the first caps may have a first spring base fixed to the inner surface of the shell to support the first end of one of the springs. Each of the second caps may have a second spring base fixed to the compressor body to support the second end of one of the springs. Each of the first spring bases may have a first inclined surface configured to contact the first end of the one of the springs. Each of the second spring bases may have a second inclined surface configured to contact the second end of the one of the springs, the first and second inclined surfaces being inclined with respect to the axial direction.

Each of the first caps may have a first spring insert that extends from the first spring base and may be configured to be inserted into the spring at the first end. Each of the second caps may have a second spring insert that extends from the second spring base and may be configured to be inserted into the spring at the second end. The first inclined surface may be orthogonal to a center line passing through a center of the first spring insert. The second inclined surface may be orthogonal to a center line passing through a center of the second spring insert.

Each of the first caps may be provided with at least one first protrusion formed on a first fixing surface which may be opposite to the first inclined surface. The inner surface of the shell may include a plurality of grooves, each groove configured to receive one first protrusion.

A direction in which the first protrusion may be inserted into the groove may be orthogonal to a direction in which the first inclined surface may be inclined. The first protrusions and the grooves may be arranged along a radial direction with respect to a center of the compressor body.

Wherein each of the second caps may be provided with a second protrusion formed on a second fixing surface which may be opposite to the second inclined surface. The second protrusion may be configured to at least partially cover a side edge of the compressor body. The second protrusion may be formed at an edge of the second fixing surface and may be provided with a bolt insertion groove or hole such that the second protrusion may be configured to be fastened to the motor at the bolt insertion groove. The bolt insertion groove or hole may be a hole, and a bolt may be configured to be inserted into the hole to fix the stator to the second protrusion.

The plurality of springs may be arranged along a circumference of the compressor body and spaced apart by predetermined intervals to be symmetrical to each other with respect to a center of the compressor body. A space between adjacent springs of the plurality of springs may increase in a direction toward the shell.

Each first cap may be fixed to the shell at a first fixing point. Each second cap may be fixed to the compressor body at a second fixing point. The first fixing point may be radially eccentric with respect to the second fixing point.

A radial distance from an axial center line of the compressor body to the first fixing point may be a first distance. A radial distance from the axial center line to the second fixing point may be a second distance. The first distance may be greater than the second distance.

The plurality of springs may be arranged along a circumference of the compressor body and spaced apart by predetermined intervals to be symmetrical to each other with respect to a transverse center line of the compressor body. The plurality of first caps may be each individually fixed to the inner surface of the shell and the plurality of second caps may be each individually fixed to the compressor body. The plurality of first caps may be connected via a first connection frame. The plurality of second caps may be connected via a second connection frame.

Embodiments disclosed herein may be implemented as a hermetic compressor comprising a shell, a compressor body provided to be spaced apart from an inner surface of the shell, the compressor body including a motor and a compression unit configured to compress a fluid via a driving force of the motor, wherein the compression unit may include a cylinder block and a piston, a plurality of springs provided between the shell and the compressor body to elastically support the compressor body with respect to the shell, and a plurality of caps fixed to the inner surface of the shell and the compressor body to support ends of each of the plurality of springs. Each of the caps may have an inclined surface contacting an end of one of the springs, the inclined surface being inclined with respect to an axial direction of the compressor body.

Each of the inclined surfaces may be formed such that a distance between adjacent springs of the plurality of springs increases in a direction toward the shell. Each of the inclined surfaces may be provided with a spring insert configured to be inserted into one spring of the plurality of springs. A longitudinal direction the spring insert may be orthogonal to an inclination of the inclined surface.

Embodiments disclosed herein may be implemented as a hermetic compressor comprising a shell, a compressor body provided inside of the shell, the compressor body including a motor and a compression unit configured to compress a fluid via a driving force of the motor, wherein the compression unit may include a cylinder block and a piston, and a plurality of springs extending between the shell and the compressor body to support the compressor body in a state spaced apart from the shell. A longitudinal direction of each spring may be inclined with respect to an axial direction of the compressor body., The plurality of springs may be inclined toward each other in a direction from the shell to the compressor body. Each spring may have a first end coupled to the shell and a second end coupled to the compressor body. The first end may be arranged to be eccentric with respect to the second end in a radial direction of the shell.

A plurality of first caps may be fixed to the shell to connect the first ends of the springs to the shell, respectively. A plurality of second caps may be fixed to the compressor body to connect the second ends of the springs to the compressor body, respectively.

Each first cap may include a first inclined surface and a first spring insert extending from the first inclined surface and inserted into the first end of the spring, the first inclined surface having a first inclination orthogonal to a longitudinal direction of the first spring insert. Each second cap may include a second inclined surface and a second spring insert extending from the second inclined surface and inserted into the second end of the spring, the second inclined surface having a second inclination orthogonal to a longitudinal direction of the second spring insert. The first inclination may be equal and opposite to the second inclination.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hermetic compressor, comprising:

a shell;

a compressor body spaced apart from an inner surface of the shell, the compressor body including a motor and a compression unit configured to compress a fluid via a driving force of the motor, wherein the compression unit includes a cylinder block and a piston;

a plurality of springs provided between the shell and the compressor body to elastically support the compressor body with respect to the shell;

a plurality of first caps fixed to the inner surface of the shell; and a plurality of second caps fixed to the compressor body, the plurality of first and second caps being configured to support first and second ends, respectively, of each of the plurality of springs, wherein each of the plurality of springs is inclined with respect to an axial direction of the compressor body, wherein each of the first caps has a first spring base fixed to the inner surface of the shell to support the first end of one of the plurality of springs, each of the second caps has a second spring base fixed to the compressor body to support the second end of the one of the plurality of springs, each of the first spring bases has a first inclined surface configured to contact the first end of the one of the plurality of springs, and each of the second spring bases has a second inclined surface configured to contact the second end of the one of the plurality of springs, wherein each of the first spring bases is supported by the inner surface of the shell in the axial direction of the compressor body, and each of the second spring bases is supported by the compressor body in the axial direction of the compressor body, wherein the first and second inclined surfaces are inclined with respect to a longitudinal direction of the each of the first spring bases and second spring bases, and wherein: each of the first caps is provided with at least one first protrusion formed on a first fixing surface which is opposite to the first inclined surface; and the inner surface of the shell includes a plurality of grooves, each groove configured to receive one first protrusion.

2. The compressor of claim 1, wherein:

each of the first caps has a first spring insert that extends from the first spring base and is configured to be inserted into the spring at the first end;

each of the second caps has a second spring insert that extends from the second spring base and is configured to be inserted into the spring at the second end;

the first inclined surface is orthogonal to a center line passing through a center of the first spring insert; and the second inclined surface is orthogonal to a center line passing through a center of the second spring insert.

3. The compressor of claim 1, wherein a direction in which the first protrusion is inserted into the groove is orthogonal to a direction in which the first inclined surface is inclined.

4. The compressor of claim 1, wherein the first protrusions and the grooves are arranged along a radial direction with respect to a center of the compressor body.

5. The compressor of claim 1, wherein each of the second caps is provided with a second protrusion formed on a second fixing surface which is opposite to the second inclined surface, and wherein the second protrusion is configured to at least partially cover a side edge of the compressor body.

6. The compressor of claim 5, wherein the second protrusion is formed at an edge of the second fixing surface and is provided with a bolt insertion groove or hole such that the second protrusion is configured to be fastened to the motor at the bolt insertion groove.

7. The compressor of claim 6, wherein the bolt insertion groove or hole is a hole, and a bolt is configured to be inserted into the hole to fix the stator to the second protrusion.

8. The compressor of claim 1, wherein the plurality of springs is arranged along a circumference of the compressor body and spaced apart by predetermined intervals to be symmetrical to each other with respect to a center of the compressor body.

9. The compressor of claim 8, wherein a space between adjacent springs of the plurality of springs increases in a direction toward the shell.

10. The compressor of claim 1, wherein:

each first cap is fixed to the shell at a first fixing point;

each second cap is fixed to the compressor body at a second fixing point; and the first fixing point is radially eccentric with respect to the second fixing point.

11. The compressor of claim 10, wherein:

a radial distance from an axial center line of the compressor body to the first fixing point is a first distance;

a radial distance from the axial center line of the compressor body to the second fixing point is a second distance; and the first distance is greater than the second distance.

12. The compressor of claim 1, wherein the plurality of springs is arranged along a circumference of the compressor body and spaced apart by predetermined intervals to be symmetrical to each other with respect to a transverse center line of the compressor body.

13. The compressor of claim 1, wherein the plurality of first caps is each individually fixed to the inner surface of the shell and the plurality of second caps is each individually fixed to the compressor body.

14. The compressor of claim 1, wherein:

the plurality of first caps is connected via a first connection frame; and the plurality of second caps is connected via a second connection frame.

* * * * *